US008201911B2

(12) United States Patent
Tatsumi

(10) Patent No.: US 8,201,911 B2
(45) Date of Patent: Jun. 19, 2012

(54) RECORDING APPARATUS AND RECORDING METHOD

(75) Inventor: Setsuji Tatsumi, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 1126 days.

(21) Appl. No.: 11/902,319

(22) Filed: Sep. 20, 2007

(65) Prior Publication Data

US 2008/0074456 A1 Mar. 27, 2008

(30) Foreign Application Priority Data

Sep. 22, 2006 (JP) ..... 2006-257795

(51) Int. Cl.
*B41J 2/205* (2006.01)

(52) U.S. Cl. ..... 347/15; 347/5; 347/19; 347/40; 347/43; 347/47

(58) Field of Classification Search ..... None
See application file for complete search history.

(56) References Cited

U.S. PATENT DOCUMENTS 6,315,392 B1 * 11/2001 Kinas et al. ..... 347/43
6,846,066 B2 * 1/2005 Teshikawara et al. ..... 347/40
2004/0090480 A1 5/2004 Teshikawara et al.

FOREIGN PATENT DOCUMENTS

JP 2004-148723 A 5/2004

* cited by examiner

*Primary Examiner* — Uyen Chau N Le
*Assistant Examiner* — Chad Smith
(74) *Attorney, Agent, or Firm* — Birch, Stewart, Kolasch & Birch, LLP

(57) ABSTRACT

A recording apparatus includes: a recording device which includes recording elements by performing deposition of ink droplets including main droplets forming main dots on a recording medium and satellite droplets accompanying the main droplets and forming subsidiary dots; a dot pattern storage device which beforehand stores a plurality of dot patterns; and a dot pattern selector device which selects the dot patterns from the dot pattern storage device, wherein when one pixel satisfies $i+j \leqq k$, where i is a main dots total number to be recorded for the pixel, j is a subsidiary dots total number to be recorded for the pixel and k is a number of the main dots to be recorded for the pixel by the recording elements of one type, then the dot pattern selector device selects certain dot patterns for the pixel.

18 Claims, 14 Drawing Sheets

FIG.3

| TYPE OF RECORDING ELEMENT | FIRST TYPE | | SECOND TYPE | | | | ... |
|---|---|---|---|---|---|---|---|
| RECORDING MODE | COMMON | | HIGH-QUALITY | | HIGH-SPEED | | COMMON |
| IDENTIFICATION NUMBER | No.1 | No.2 | No.1 | No.2 | No.1 | No.2 | ... |
| Level 0 | | | | | | | ... |
| Level 1 | | | | | | | ... |
| Level 2 | | | | | | | ... |
| ... | ... | ... | ... | ... | ... | ... | ... |
| Level 8 | | | | | | | ... |

GRADUATED TONE VALUE

RECORDING APPARATUS AND RECORDING METHOD

BACKGROUND OF THE INVENTION

1. Field of the Invention

The present invention relates to a recording apparatus and recording method for performing recording on a prescribed recording medium on the basis of prescribed recording data for a plurality of pixels, by using a recording device which records dots by ejecting droplets of ink onto the recording medium.

2. Description of the Related Art

An inkjet recording apparatus has been known which ejects droplets of inks of mutually different colors on a prescribed recording medium, and an inkjet recording apparatus has also been known which ejects droplets of inks of mutually different droplet volumes onto a prescribed recording medium.

In the case of an image in which the same tonal graduation continues, cyclical density non-uniformities or streaks may appear on the recording medium, due to error in the ink depositing position, or error in the scanning accuracy (and more specifically, error in the feed accuracy of the recording medium, and error in the feed accuracy of the carriage of the recording head).

Furthermore, the occurrence of cyclical density non-uniformities or streaks is closely related to the coverage rate of the dots per unit surface area of the recording medium. In particular when images having low to medium tonal regions are recorded, if dots of mutually different sizes are recorded onto coinciding positions on the recording medium, then the effective dot coverage rate becomes low and density non-uniformities and streaks become readily visible.

Furthermore, if a plurality of dots of mutually different sizes or a plurality of dots of mutually different colors are recorded on the same positions on the recording medium in one scanning operation, then when observed locally, the ink is not absorbed completely into the recording medium, the dot shapes on the recording medium are disturbed, and an impression of undesirable "image noise" may occur in the formed image.

Japanese Patent Application Publication No. 2004-148723 discloses an inkjet recording apparatus which carries out recording on a recording medium, on the basis of recording data represented by a graduated tone value (the n value), using a recording device having first recording elements and second recording elements which record dots of mutually different sizes. The inkjet recording apparatus includes: a storage device which previously stores a plurality of dot patterns; a device which selects dot patterns corresponding to the respective graduated tone values of the recording data, from the plurality of dot patterns previously stored in the storage device; and a control device which performs recording by means of the first recording elements and the second recording elements, in accordance with the data in the buffer, wherein the storage device stores dot patterns in which the dot positions of the first recording elements and the second recording elements do not coincide.

An inkjet recording apparatus has been known which is able to eject very small droplets of approximately 1 picoliter (pl). Such a very small liquid droplet is typically accompanied by a satellite droplet (also referred to as a "sub-droplet" or "subsidiary droplet") having substantially the same size as the main droplet. Therefore, when considering the dot arrangement, it is necessary to take account of the dot positions of the satellite droplets, as well as the dot positions of the main droplets.

Japanese Patent Application Publication No. 2004-148723 discloses a composition which uses dot patterns where the positions of two dots do not coincide, in order to improve the coverage rate per unit surface area, of small dots and large dots on the recording medium. However, in cases where satellite droplets have large effects, in other words, if the dot coverage rate per unit surface area, of the dots composed of satellite droplets deposited on the recording medium is close to the coverage rate per unit surface area, of the dots composed of main droplets deposited on the recording medium, then it is difficult to avoid density non-uniformities or disturbance of the dot shapes unless the satellite droplets are taken into account.

This problem is described here with reference to FIG. 18. In FIG. 18, a large dot pattern 91 for a first recording element which records a large dot onto the recording medium, and a small dot pattern 92 for a second recording element which records a small dot onto the recording medium, form a set of dot patterns in which the dot positions do not coincide with each other. However, in a synthesized dot pattern 95 obtained by combining the dot pattern 93 which indicates the position of the dot 93M actually recorded on the recording medium by the first recording element, and the dot pattern 94 which indicates the positions of the dots 94M and 94S actually recorded on the recording medium by the second recording element, there is coincidence in the dot positions on the recording medium between the dot 93M recorded by the main droplet ejected from the first recording element and the dot 94S recorded by the satellite droplet ejected from the second recording element.

The problem of coincidence between the dot position of a main droplet and the dot position of a satellite droplet as described above occurs similarly between inks of different colors.

SUMMARY OF THE INVENTION

The present invention has been contrived in view of the aforementioned circumstances, an object thereof being to provide a recording apparatus and a recording method whereby density non-uniformities and disturbance of the dot shapes is not liable to occur.

In order to attain the aforementioned object, the present invention is directed to a recording apparatus which records dots on a recording medium in accordance with recording data for a plurality of pixels, the recording apparatus comprising: a recording device which includes recording elements of a plurality of types which record the dots of mutually different types on the recording medium by performing deposition of ink droplets onto the recording medium, the ink droplets including main droplets forming main dots on the recording medium and satellite droplets accompanying the main droplets and forming subsidiary dots on the recording medium, each of the pixels having a plurality of graduated tone values respectively for the plurality of types of the recording elements, each of the graduated tone values being an integer not less than 0 and not greater than m that is not less than 2; a dot pattern storage device which beforehand stores a plurality of dot patterns specifying arrangements of the main dots for each of the plurality of types of the recording elements, the plurality of dot patterns being stored respectively in association with pattern numbers which are integers from 0 through m; a buffer device which stores droplet deposition data used by the recording device for the deposition of the ink droplets; and a dot pattern selector device which selects the dot patterns from the dot pattern storage device corresponding respectively to the graduated tone values for the plurality of types of the recording elements, the selected dot patterns being developed and stored as the droplet deposition data on the buffer device, wherein when one of the pixels satisfies a relationship of $i+j \leqq k$, where i is a total number of the main dots to be recorded for the one of the pixels by the recording elements of at least two of the types, j is a total number of the subsidiary dots to be recorded for the one of the pixels by the recording elements of the at least two of the types, and k is a number of the main dots to be recorded for the one of the pixels by the recording elements of one of the types if a graduated tone value of the one of the pixels for the recording elements of the one of the types is m, then the dot pattern selector device selects the dot patterns for the one of the pixels so that, between the recording elements of different types of the at least two types, there is no coincidence in positions of the main dots with each other and there is no coincidence in the positions of the main dots with positions of the subsidiary dots.

Here, the satellite droplet (hereinafter, also referred to as "subsidiary droplet") contemplated in the present invention is the largest satellite droplet which is ejected from the same nozzle (liquid ejection port) as a main droplet, following the ejection of the main droplet.

According to this aspect of the present invention, when a particular pixel satisfies the relationship of $i+j \leqq k$, then the dot pattern selector device selects the dot patterns for that pixel so that, between the recording elements of different types of the at least two types, there is no coincidence in positions of the main dots with each other and there is no coincidence in the positions of the main dots with positions of the subsidiary dots, and therefore even under conditions where the main droplets are very small (conditions under which subsidiary droplets (satellite droplets) are liable to occur in the form of independent droplets), coincidence in the positions of the dots including the subsidiary dots, is avoided, and density non-uniformity or disturbance of the dot shapes is suppressed.

Preferably, the recording elements of the plurality of types record the dots of the mutually different types that are mutually different in terms of at least one of ink color and dot size.

Preferably, when the one of the pixels satisfies the relationship of $i+j \leqq k$, then the dot pattern selector device selects the dot patterns for the one of the pixels so that, between the recording elements of a same type of the at least two types, there is no coincidence in the positions of the main dots with each other and there is no coincidence in the positions of the main dots with the positions of the subsidiary dots.

Preferably, when the one of the pixels satisfies the relationship of $i+j \leqq k$, then the dot pattern selector device selects the dot patterns for the one of the pixels so that, between the recording elements of a same type of the at least two types, there is no coincidence in the positions of the subsidiary dots with each other.

Preferably, when the one of the pixels satisfies the relationship of $i+j \leqq k$, then the dot pattern selector device selects the dot patterns for the one of the pixels so that, between the recording elements of the different types of the at least two types, there is no coincidence in the positions of the subsidiary dots with each other.

Preferably, the dot pattern storage device beforehand stores the plurality of dot patterns including a first dot pattern stored in association with one of the pattern numbers for a first type of the types of the recording elements and a second dot pattern stored in association with one of the pattern numbers for a second type of the types of the recording elements so that, between the first dot pattern and the second dot pattern, there is no coincidence in the positions of the main dots with each other and there is no coincidence in the positions of the main dots with the positions of the subsidiary dots, if a relationship of $o+p \leqq k$ is satisfied between the first dot pattern and the second dot pattern, where o is a total number of the main dots arranged in the first dot pattern and the second dot pattern, and p is a total number of the subsidiary dots accompanying the main dots in the first dot pattern and the second dot pattern.

Preferably, the recording device has a plurality of recording modes in which the recording device moves relative to the recording medium at mutually different scanning speeds, the recording device selecting one of the recording modes to record the dots on the recording medium; the dot pattern storage device stores the dot patterns in association with the plurality of recording modes; and the dot pattern selector device selects the dot patterns in accordance with the selected recording mode so that, between the recording elements of the different types of the at least two types, there is no coincidence in the positions of the main dots with each other and there is no coincidence in the positions of the main dots with the positions of the subsidiary dots.

According to this aspect of the present invention, even when the scanning speed changes (recording mode is changed), density non-uniformity and disturbance of the dot shapes is suppressed.

Preferably, the recording device has a plurality of recording modes including a high-quality recording mode for forming an image at higher quality on the recording medium than another of the recording modes; and at least when the recording device is operated in the high-quality recording mode, the dot pattern selector device selects the dot patterns so that, between the recording elements of the different types of the at least two types, there is no coincidence in the positions of the main dots with each other and there is no coincidence in the positions of the main dots with the positions of the subsidiary dots.

According to this aspect of the present invention, at least when the recording device is operated in the high-quality recording mode, then density non-uniformity and disturbance of the dot shapes is suppressed.

Preferably, the plurality of types of the recording elements include a first type and a second type, the main dots recorded by the recording element of the first type being smaller than the main dots recorded by the recording element of the second type; and when the one of the pixels satisfies the relationship of $i+j \leqq k$ where the at least two of the types are the first type and the second type, the dot pattern selector device selects the dot patterns so that there is no coincidence among positions of the main dots recorded by the recording element of the first type, positions of the subsidiary dots recorded by the recording element of the first type, and positions of the main dots recorded by the recording element of the second type.

Preferably, the plurality of types of the recording elements include a first type and a second type which record the main dots with mutually different colors on the recording medium; and when the one of the pixels satisfies the relationship of $i+j \leqq k$ where the at least two of the types are the first type and the second type, the dot pattern selector device selects the dot patterns so that there is no coincidence among positions of the main dots recorded by the recording element of the first type, positions of the subsidiary dots recorded by the recording element of the first type, positions of the main dots recorded by the recording element of the second type, and positions of the subsidiary dots recorded by the recording element of the second type.

Preferably, the plurality of types of the recording elements further include a third type, the recording element of the third type ejecting droplets of yellow color ink; the recording element of the first type ejects droplets of cyan color ink; the recording element of the second type ejects droplets of magenta color ink; and when the one of the pixels satisfies the relationship of $i+j \leqq k$ where the at least two of the types are the first type and the second type, the dot pattern selector device selects the dot patterns so that there is no coincidence among the positions of the main dots recorded by the recording element of the first type, the positions of the subsidiary dots recorded by the recording element of the first type, the positions of the main dots recorded by the recording element of the second type, and the positions of the subsidiary dots recorded by the recording element of the second type.

In the case of the blue colors, the density non-uniformities and the disturbance in the dot shapes are typically very noticeable compared to another color. However, according to this aspect of the present invention, it is possible to avoid density non-uniformities or disturbance in the dot shapes in blue colors.

Preferably, the recording elements of the plurality of types record the dots of mutually different types that are mutually different in terms of a combination of ink color and dot size; the plurality of types of the recording elements are categorized into at least a first group and a second group, the recording elements of the types of the first group recording the dots of a first ink color, the recording elements of the types of the second group recording the dots of a second ink color; and when the one of the pixels satisfies the relationship of $i+j \leqq k$ where the at least two of the types are the types belonging to the first group and the second group, the dot pattern selector device selects the dot patterns so that there is no coincidence in positions of the main dots of the first ink color and the second ink color with each other, there is no coincidence in positions of the subsidiary dots of the first ink color and the second ink color with each other, and there is no coincidence in the positions of the main dots of the first ink color and the second ink color with the positions of the subsidiary dots of the first ink color and the second ink color.

Preferably, the first ink color is magenta, and the second ink color is cyan.

In the case of the blue colors, the density non-uniformities and the disturbance in the dot shapes are typically very noticeable compared to another color. However, according to this aspect of the present invention, it is possible to avoid density non-uniformities or disturbance in the dot shapes in blue colors.

In order to attain the aforementioned object, the present invention is also directed to a recording method for a recording apparatus which records dots on a recording medium in accordance with recording data for a plurality of pixels by means of a recording device, the recording device including recording elements of a plurality of types which record the dots of mutually different types on the recording medium by performing deposition of ink droplets onto the recording medium, the ink droplets including main droplets forming main dots on the recording medium and satellite droplets accompanying the main droplets and forming subsidiary dots on the recording medium, each of the pixels having a plurality of graduated tone values respectively for the plurality of types of the recording elements, each of the graduated tone values being an integer not less than 0 and not greater than m that is not less than 2, the recording method comprising the steps of: storing in a storage device a plurality of dot patterns specifying arrangements of the main dots for each of the plurality of types of the recording elements, the plurality of dot patterns being stored respectively in association with pattern numbers which are integers from 0 through m; then selecting the dot patterns from the storage device corresponding respectively to the graduated tone values for the plurality of types of the recording elements; then developing and storing the selected dot patterns as droplet deposition data on a buffer device; and then recording the dots on the recording medium by means of the recording device, by using the droplet ejection data, wherein in the step of selecting the dot patterns, when one of the pixels satisfies a relationship of $i+j \leqq k$, where i is a total number of the main dots to be recorded for the one of the pixels by the recording elements of at least two of the types, j is a total number of the subsidiary dots to be recorded for the one of the pixels by the recording elements of the at least two of the types, and k is a number of the main dots to be recorded for the one of the pixels by the recording elements of one of the types if a graduated tone value of the one of the pixels for the recording elements of the one of the types is m, then the dot patterns are selected for the one of the pixels so that, between the recording elements of different types of the at least two types, there is no coincidence in positions of the main dots with each other and there is no coincidence in the positions of the main dots with positions of the subsidiary dots.

According to the present invention, even in a case where the main droplets are very small, it is possible to prevent the occurrence of density non-uniformities or disturbance of dot shapes.

BRIEF DESCRIPTION OF THE DRAWINGS

The nature of the present invention, as well as other objects and benefits thereof, will be explained in the following with reference to the accompanying drawings, in which like reference characters designate the same or similar parts throughout the figures and wherein:

FIG. 3 is an illustrative diagram showing a dot pattern table according to an embodiment of the present invention;

DETAILED DESCRIPTION OF THE PREFERRED EMBODIMENTS

Figure 1:
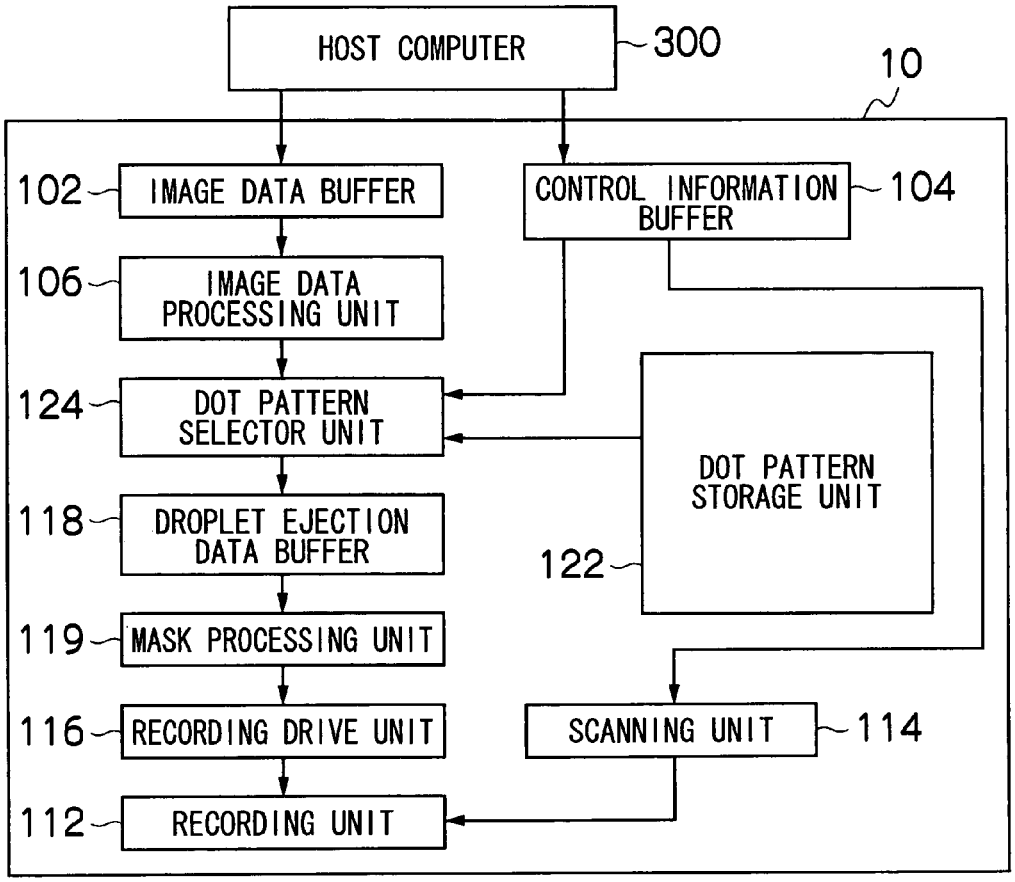
FIG. 1 is a principal block diagram showing the general composition of an inkjet recording apparatus forming a recording apparatus according to an embodiment of the present invention.

FIG. 1 is a principal block diagram showing an example of the general composition of an inkjet recording apparatus 10 forming the recording apparatus according to an embodiment of the present invention.

As shown in FIG. 1, the inkjet recording apparatus 10 includes: a recording unit 112 which records dots by ejecting droplets of ink on a prescribed recording medium, such as paper; a scanning unit 114 which moves the recording unit 112 with respect to the recording medium, in a prescribed scanning direction (at least one of a main scanning direction and a sub-scanning direction); a recording drive unit 116 which drives and causes the recording unit 112 to eject droplets of ink; a droplet ejection data buffer 118 which stores droplet ejection data for the whole recording area used in droplet ejection by the recording unit 112; and a mask processing unit 119 which carries out mask processing for generating droplet ejection data for at least each scanning action of the recording unit 112 (for at least one of a single main scanning action and a single sub-scanning action), on the basis of the droplet ejection data for the whole recording area stored in the droplet ejection data buffer 118.

The recording unit 112 has a plurality of different types of recording elements which record mutually different types of dots. More specifically, the recording unit 112 has a plurality of types of recording elements which eject droplets of inks with mutually different colors. For example, it has recording elements which eject respective ink colors of cyan (C), magenta (M), yellow (Y) and black (K). The recording unit 112 may also have recording elements for ink colors of soft cyan (SC), and soft magenta (SM). Moreover, the recording unit 112 may also have a plurality of types of recording elements which record dots (hereinafter, called "main dots") with mutually different sizes on the recording medium by means of main droplets. For example, it may have large dot recording elements which record main dots of a prescribed size, and small dot recording elements which record main dots that are smaller than the main dots recorded by the large dot recording elements.

Furthermore, the inkjet recording apparatus 10 includes: an image data buffer 102 which stores original image data acquired from a host apparatus 300; a control information buffer 104 which stores control information acquired from the host apparatus 300; and an image data processing unit 106 which converts the original image data acquired from the host apparatus 300 into the image data for a plurality of pixels (hereinafter, called "recording data"). Each of the pixels has graduated tone values for the plurality of types of the recording elements of the recording unit 112.

The recording data acquired by the image data processing unit 106 is constituted of a plurality of pixels, and each pixel has a plurality of graduated tone values that are respectively quantized for the types of recording element (more specifically, each pixel has graduated tone values that are respectively quantized for ink colors, and/or quantized for dot sizes). For example, one pixel has four graduated tone values, namely a graduated tone value for a C ink dot, a graduated tone value for an M ink dot, a graduated tone value for a Y ink dot and a graduated tone value for a K ink dot. Furthermore, one pixel has, for example, two graduated tone values, one for a large dot and one for a small dot. Moreover, for example, one pixel has eight graduated tone values, namely, a graduated tone value for a large dot of C ink, a graduated tone value for a small dot of C ink, a graduated tone value for a large dot of M ink, a graduated tone value for a small dot of M ink, a graduated tone value for a large dot of Y ink, a graduated tone value for a small dot of Y ink, a graduated tone value for a large dot of K ink, and a graduated tone value for a small dot of K ink.

The graduated tone value is also known as the n value. The graduated tone value is divided into n levels (tonal graduations) (where n is an integer equal to or greater than 3). In other words, each graduated tone value is an integer not less than 0 and not greater than m (where m equals to n−1; m is an integer equal to or greater than 2). For example, if n=9 (9 tonal graduations; in other words m=8), then the graduated tone value is divided into nine levels (levels 0 to 8). One graduated tone value indicates a particular level (tonal graduation) amongst the n levels.

The control data includes a recording mode indication data which indicates the recording mode, such as a high-quality recording mode or a high-speed recording mode, or the like.

Furthermore, the inkjet recording apparatus 10 includes: a dot pattern storage unit 122 which previously stores a plurality of dot patterns, in the form of a dot pattern table; and a dot pattern selector unit 124 which, when droplet ejection data is generated from the recording data, successively processes the plurality of pixels, and selects dot patterns for graduated tone values of a pixel under processing, from the plurality of dot patterns previously stored in the dot pattern storage unit 122. The dot patterns selected by the dot pattern selector unit 124 are developed and stored as the droplet ejection data in the droplet ejection data buffer 118.

Each of the dot patterns stored in the dot pattern storage unit 122 indicates the arrangement of dots (main dots) to be recorded on the recording medium by means of main droplets ejected from the corresponding type of the recording element in the recording unit 112 in accordance with the graduated tone value for that type of the recording element. In other words, the dot pattern indicates the presence or absence of a main dot in each of a plurality of dot positions (for example, 4×4 dot positions) in accordance with the graduated tone value, for each of the pixels in the recording data. Furthermore, the plurality of dot patterns are stored in the dot pattern storage unit 122 in the form of a dot pattern table, in association with pattern numbers which are integers from 0 through m (for example, in the case of n=9, pattern numbers are integers from 0 through 8 (level 0 to level 8)). In this case, the presence or absence of dots (hereinafter, referred to as "subsidiary dots" or "sub dots") recorded on the recording medium by means of subsidiary liquid droplets (satellite droplets) which are generated in conjunction with the ejection of main droplets from the recording elements, is not included in the dot patterns.

Although there may occur a plurality of satellite droplets that accompany one main droplet, the satellite droplet contemplated in the present invention is the largest droplet (in this case, the first satellite droplet) of the satellite droplets that are ejected from the same nozzle as that of the main droplet, following the ejection of the main droplet.

When one of the pixels satisfies a relationship of $i+j \leqq k$, where i is a total number of the main dots to be recorded for the one of the pixels by the recording elements of at least two types (for example, a type of the recording elements for C ink dots and a type of the recording elements for M ink dots) of all types (for example, four types of recording elements, namely, a type of the recording elements for C ink dots, a type of the recording elements for M ink dots, a type of the recording elements for Y ink dots and a type of the recording elements for K ink dots), j is a total number of the subsidiary dots to be recorded for the one of the pixels by the recording elements of the at least two of the types, and k is a number (maximum number of the dots to be arranged in one dot pattern) of the main dots to be recorded for the one of the pixels by the recording elements of one of the types if a graduated tone value of the one of the pixels for the recording elements of the one of the types is m, then the dot pattern selector device 124 selects the dot patterns for the one of the pixels so that, between the recording elements of different types (for example, between the type of the recording elements for the C ink dots and the type of the recording elements for the M ink dots) of the at least two types, there is at least no coincidence in positions of the main dots with each other and there is no coincidence in the positions of the main dots with positions of the subsidiary dots. For example, if n=9 (9 tonal graduations; levels 0 to 8; and m=8), then when the sum (i+j) of the number of main dots and the number of subsidiary dots for one pixel is equal to or less than the maximum number (k) of dots (8 dots) which correspond to the maximum value (m=level 8) of the graduated tone value, a set of dot patterns are selected for that pixel so that there is no coincidence in the positions of the main dots, and no coincidence in the positions of main dots and the positions of subsidiary dots, between the particular types of recording elements (for example, between the type of the recording elements for the C ink dots and the type of the recording elements for the M ink dots). This dot pattern selection processing is successively carried out (repeated) for all of the pixels.

Here, when one pixel satisfies the condition described above (i.e., $i+j \leqq k$) between particular types of recording elements (for example, the type of the recording elements for C ink dots and the type of the recording elements for M ink dots), then the dot patterns selected by the dot pattern selector unit 124 are preferably dot patterns such that, moreover, there is no coincidence in the positions of the main dots, between any recording elements of the same type, amongst the recording elements of the particular types.

Furthermore, when one pixel satisfies the condition described above (i.e., $i+j \leqq k$) between particular types of recording elements (for example, the type of the recording elements for C ink dots and the type of recording elements for M ink dots), then the dot patterns selected by the dot pattern selector unit 124 are preferably dot patterns such that, moreover, there is no coincidence in the positions of the main dots and the positions of the subsidiary dots between any recording elements of the same type, amongst the recording elements of the particular types.

Furthermore, when one pixel satisfies the condition described above (i.e., $i+j \leqq k$) between particular types of recording elements (for example, the type of the recording elements for C ink dots and the type of recording elements for M ink dots), then the dot patterns selected by the dot pattern selector unit 124 are preferably dot patterns such that, moreover, there is no coincidence in the positions of the subsidiary dots, between any recording elements of the same type, amongst the recording elements of the particular types.

Furthermore, when one pixel satisfies the condition described above (i.e., $i+j \leqq k$) between particular types of recording elements (for example, the type of the recording elements for C ink dots and the type of recording elements for M ink dots), then the dot patterns selected by the dot pattern selector unit 124 are preferably dot patterns such that, moreover, there is no coincidence in the positions of the subsidiary dots, between any recording elements of different types, amongst the recording elements of the particular types.

Figure 2:
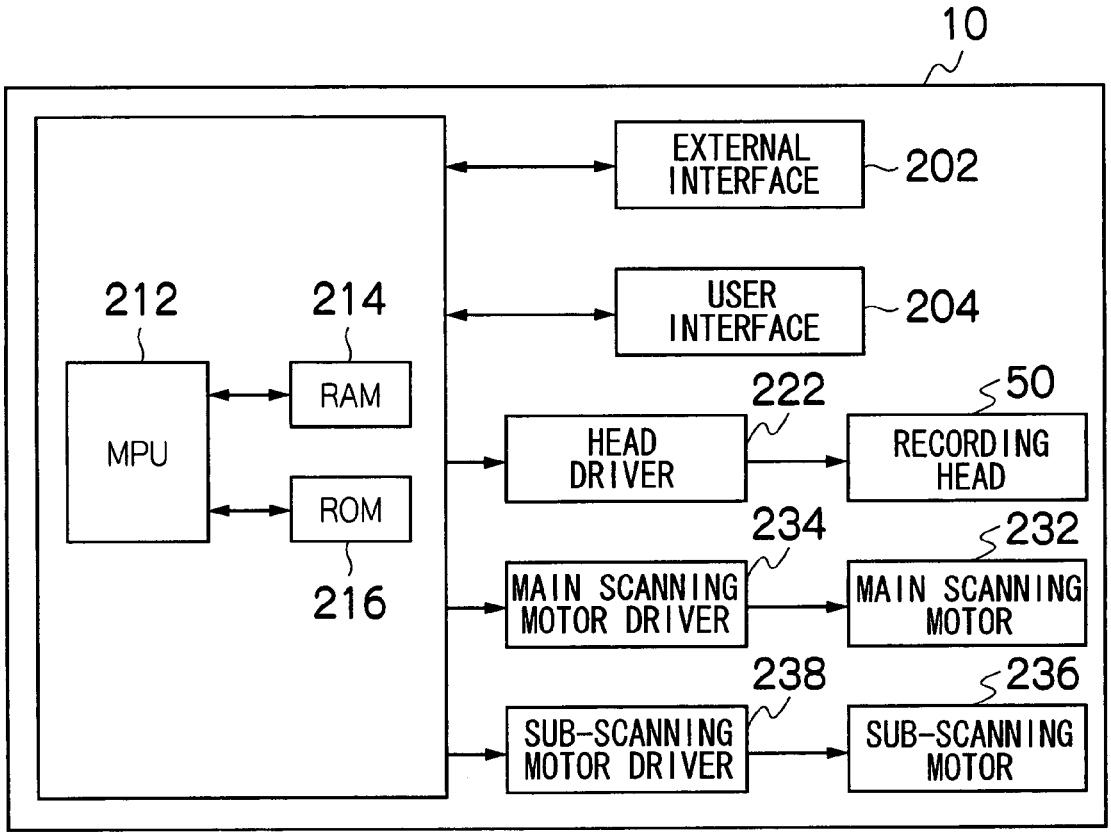
FIG. 2 is a principal block diagram showing one example of a specific hardware configuration of the inkjet recording apparatus shown in FIG. 1.

FIG. 2 is a principal block diagram showing one example of a specific hardware composition of the inkjet recording apparatus 10 shown in FIG. 1.

In FIG. 2, an external interface 202 is an interface via which original image data and control information is input in the form of an input signal, from a source external to the inkjet recording apparatus 10. More specifically, it is a communication interface which communicates with the host apparatus 300 in FIG. 1, by means of a wired or a wireless connection. A user interface 204 is an interface via which various instructions are input by the user. For example, the user interface 204 may be an operating panel having an LCD screen (liquid crystal display) and operating buttons.

An MPU (Micro Processing Unit) 212 functions as a microcomputer which executes various processes in accordance with a prescribed program. A RAM (Random Access Memory) 214 stores various types of variable data. A ROM (Read Only Memory) 216 stores the programs and fixed data which is to be executed by the MPU 212.

A recording head 50 has recording elements of a plurality of types which record dots of mutually different types, and it ejects ink toward the recording medium. An example of the recording head 50 is described in detail below. A head driver 222 is composed of a driver circuit which drives the recording head 50.

A main scanning motor 232 is a motor which causes the recording head 50 to move (scan) relatively with respect to the recording medium, in a direction (main scanning direction) which is perpendicular to the conveyance direction of the recording medium. A main scanning motor driver 234 is a circuit which drives the main scanning motor 232. A sub-scanning motor 236 is a motor which causes the recording head 50 to move (scan) relatively with respect to the recording medium, in the conveyance direction of the recording medium (the sub-scanning direction). A sub-scanning motor driver 238 is a circuit which drives the sub-scanning motor 236.

The inkjet recording apparatus 10 shown in FIG. 2 is a multi-pass type of printer in which the recording head 50 moves with respect to a recording medium, in both a main scanning direction and a sub-scanning direction, but the present invention is not limited to a multi-pass type of apparatus of this kind, and it may also be applied to a single-pass type of apparatus in which the recording head 50 moves with respect to the recording medium, in the sub-scanning direction only.

To give a brief description of the correspondence between the hardware composition of the inkjet recording apparatus 10 shown in FIG. 2 and the composition shown in FIG. 1, the image data processing unit 106, the dot pattern selector unit 124 and the mask processing unit 119 in FIG. 1 are constituted by the MPU 212; the image data buffer 102, the control information buffer 104 and the droplet ejection data buffer 118 in FIG. 1 are constituted by the RAM 214; the dot pattern storage unit 122 shown in FIG. 1 is constituted by the ROM 216; the recording unit 112 shown in FIG. 1 is constituted by the recording head 50; the recording drive unit 116 shown in FIG. 1 is constituted by the head driver 222; and the scanning unit 114 shown in FIG. 1 is constituted by the main scanning motor 232, the main scanning motor driver 234, the sub-scanning motor 236 and the sub-scanning motor driver 238.

FIG. 3 shows one example of a dot pattern table composed of a plurality of dot patterns, which is stored in the dot pattern storage unit 122 in FIG. 1.

In FIG. 3, the size of each dot pattern is 2 dots by 4 dots (the maximum number of dots to be arranged is 2 dots×4 dots=8 dots), and the graduated tone value is a 4-bit value where n=9 (level 0 to level 8; in other words, m=8).

In the dot pattern storage unit 122, a set of dot patterns are beforehand stored in association with pattern numbers (levels 0 to 8) which are integers from 0 through m (in FIG. 3, integers from 0 through 8). The dot patterns are subsequently selected from the set of dot patterns thus stored beforehand, in accordance with the graduated tone values of the types of recording elements. For the sake of convenience, the dot patterns relating to dot numbers 3 to 7 (levels 3 to 7) are omitted in FIG. 3.

In the present embodiment, the pattern number (level) is equal to the number of main dots to be recorded onto the recording medium. For example, for one pixel, 0 main dots are recorded onto the recording medium in the case of pattern number 0 (level 0); 1 dot is recorded in the case of pattern number 1; 2 dots are recorded in the case of pattern number 2; and 8 dots are recorded in the case of pattern number 8. Similarly, in the cases of pattern numbers 3 to 7, each pattern number (an integer between 3 and 7) indicates the number of main dots to be recorded.

Furthermore, in the dot pattern storage unit 122, a plurality of dot patterns which can be selected for the types of the recording elements, are stored in advance in association with the plurality of types of recording elements, which record dots of mutually different types, as shown in FIG. 3. In other word, the dot patterns are stored in association with all the types of the recording elements, for each of the pattern numbers (each of the integers from 0 through 8), as shown in FIG. 3. The dot patterns associated with types other than the first type and the second type (namely, the third to eighth types), are omitted in FIG. 3 for the sake of convenience.

For example, the recording elements of the first type are elements which eject droplets of cyan colored ink (recording elements for C ink dots), and the recording elements of the second type are elements which eject droplets of magenta colored ink (recording elements for M ink dots).

To give another example, the recording elements of the first type are elements which record large dots on the recording medium by means of main droplets (large dot recording elements), and the recording elements of the second type are elements which record small dots on the recording medium by means of main droplets (small dot recording elements), for example.

A plurality of dot patterns may be stored in advance in the dot pattern storage unit 122, in association with recording modes including a high-quality recording mode and a high-speed recording mode. In this case, the dot patterns can be selected according to a selected mode of the recording modes.

As shown in FIG. 3, a common dot pattern is stored for both of the recording modes, in the case of the recording elements of the first type. On the other hand, different dot patterns are stored for the two different recording modes, in the case of the recording elements of the second type.

Furthermore, dot patterns having different identification numbers (No.) are also registered in the dot pattern storage unit 122.

In the present embodiment, the dot pattern storage unit 122 stores two dot patterns which can be selected, for each case where the three conditions (type of recording element, recording mode and graduated tone value) are the same.

When the three conditions (type of recording element, recording mode and graduated tone value) are the same, the dot pattern selector unit 124 uses a set of dot patterns with one of the identification numbers 1 and 2 (in other words, the dot pattern selector unit 124 uses a set of dot patterns with identification number 1 or a set of dot patterns with identification number 2 to select the dot patterns, at an even probability rate (½ probability)). In principle, if the type of recording element and the recording mode are the same, then the dot pattern selector unit 124 alternately selects the dot pattern having identification number 1 and the dot pattern having identification number 2, provided that the graduated tone value is constant.

Preferably, the dot pattern storage device 122 beforehand stores a set of dot patterns including a first dot pattern stored in association with one of the pattern numbers for a first type of the recording elements (for example, a type of the recording elements for the C ink dots) and a second dot pattern stored in association with one of the pattern numbers for a second type of the recording elements (for example, a type of the recording elements for the M ink dots) so that, between the first dot pattern and the second dot pattern, there is no coincidence in the positions of the main dots with each other and there is no coincidence in the positions of the main dots with the positions of the subsidiary dots, if a relationship of $o+p \leqq k$ is satisfied between the first dot pattern and the second dot pattern, where o is a total number of the main dots arranged in the first dot pattern and the second dot pattern, p is a total number of the subsidiary dots accompanying the main dots in the first dot pattern and the second dot pattern, and k is a number (maximum number of the dots to be arranged in the dot pattern) of the main dots to be recorded for the one of the pixels by the recording elements of one of the types if a graduated tone value of the one of the pixels for the recording elements of the one of the types is m.

Preferably, the dot pattern storage device 122 beforehand stores a set of dot patterns including the first dot pattern and the second dot pattern so that there is no coincidence in the positions of the main dots arranged the first dot pattern with each other, if the relationship of $o+p \leqq k$ is satisfied between the first dot pattern and the second dot pattern. Similarly, it is preferable that the dot pattern storage device 122 beforehand stores a set of dot patterns including the first dot pattern and the second dot pattern so that there is no coincidence in the positions of the main dots arranged the second dot pattern with each other, if the relationship of $o+p \leqq k$ is satisfied between the first dot pattern and the second dot pattern.

Preferably, the dot pattern storage device 122 beforehand stores a set of dot patterns including the first dot pattern and the second dot pattern so that there is no coincidence in the positions of the main dots arranged in the first dot pattern with the positions of the subsidiary dots arranged in the first dot pattern, if the relationship of $o+p \leqq k$ is satisfied between the first dot pattern and the second dot pattern. Similarly, it is preferable that the dot pattern storage device 122 beforehand stores a set of dot patterns including the first dot pattern and the second dot pattern so that there is no coincidence in the positions of the main dots arranged in the second dot pattern with the positions of the subsidiary dots arranged in the second dot pattern, if the relationship of $o+p \leqq k$ is satisfied between the first dot pattern and the second dot pattern.

Preferably, the dot pattern storage device 122 beforehand stores a set of dot patterns including the first dot pattern and the second dot pattern so that there is no coincidence in the positions of the subsidiary dots arranged the first dot pattern with each other, if the relationship of $o+p \leqq k$ is satisfied between the first dot pattern and the second dot pattern. Similarly, it is preferable that the dot pattern storage device 122 beforehand stores a set of dot patterns including the first dot pattern and the second dot pattern so that there is no coincidence in the positions of the subsidiary dots arranged the second dot pattern with each other, if the relationship of $o+p \leqq k$ is satisfied between the first dot pattern and the second dot pattern.

Preferably, the dot pattern storage device 122 beforehand stores a set of dot patterns including the first dot pattern and the second dot pattern so that there is no coincidence in the positions of the subsidiary dots arranged the first dot pattern with the positions of the subsidiary dots arranged the second dot pattern, if the relationship of $o+p \leqq k$ is satisfied between the first dot pattern and the second dot pattern.

The dot pattern selector unit 124 selects the various dot patterns on the basis of the dot pattern table shown in FIG. 3. Specific examples of selecting the dot patterns are given below.

Firstly, it is supposed that the recording elements of the first type are used for recording small dots, and the recording elements of the second type are used for recording large dots, and that the occurrence of subsidiary droplets when recording large dots is sufficiently small to be ignorable, or the speed of flight of the subsidiary droplets occurring in the recording of large dots is enough fast for the subsidiary droplet to deposit on virtually the same position as the main droplet. In this case, when the sum of the number of main dots and the number of subsidiary droplets of the recording elements of the first type and the recording elements of the second type is equal to or less than the maximum number of dots in a dot pattern (here, "8") (when the relationship of $i+j \leqq k$ is satisfied), the dot pattern selector unit 124 ignores coincidence in the positions of the subsidiary dots between recording elements of the first type and recording elements of the second type, and selects dot patterns such that there is no coincidence among the positions of main dots of the recording elements of the first type, the positions of the subsidiary dots of the recording elements of the first type, and the positions of the main dots of the recording elements of the second type.

The present invention is not limited in particular to cases of this kind. If the recording elements of the first type are used for recording small dots and the recording elements of the second type are used for recording large dots, and if the occurrence of subsidiary droplets when recording large dots cannot be ignored and the speed of flight of the subsidiary droplets occurring in the recording of large dots is slow and the subsidiary droplet deposit at a different position from that of the main droplet, then for each pixel, if the sum of the number of main dots and the number of subsidiary dots of the recording elements of the first type and the recording elements of the second type is equal to or less than the maximum number of dots in a dot pattern (here, "8"), the dot pattern selector unit 124 may select dot patterns such that there is no coincidence among the positions of the main dots of the recording elements of the first type, the positions of the subsidiary dots of the recording elements of the first type, the positions of the main dots of the recording elements of the second type, and the positions of the subsidiary dots of the second type.

Secondly, if the recording elements of the first type are used to record C (cyan) ink dots, the recording elements of the second type are used to record M (magenta) ink dots, and the recording elements of a third type are used to record Y (yellow) ink dots, then for each pixel, when the total of the number of main dots and the number of subsidiary dots of the recording elements of the first type and the recording elements of the second type is equal to or less than the maximum number of dots in a dot pattern (here, "8" or less) (when the relationship of $i+j \leqq k$ is satisfied), then the dot pattern selector unit 124 selects dot patterns such that there is no coincidence among the positions of the main dots of the recording elements of the first type, the positions of the subsidiary dots of the recording elements of the first type, the positions of the main dots of the recording elements of the second type, and the positions of the subsidiary dots of the recording elements of the second type. Although there exist recording elements of a third type which are used to record Y (yellow) ink dots, coincidence between the positions of the Y ink dots and C ink dots, or coincidence between the positions of the Y ink dots and the M ink dots entails little problem in terms of visual characteristics, and can therefore be ignored.

Thirdly, a case will be described in which there are a plurality of types of recording elements having mutually different combinations of ink color and main dot size. For example, the recording elements of the first type are used for recording large dots of C ink, the recording elements of the second type are used for recording small dots of C ink, the recording elements of the third type are used for recording large dots of M ink, the recording elements of the fourth type are used for recording small dots of M ink, the recording elements of the fifth type are used for recording large dots of Y ink, and the recording elements of the sixth type are used for recording small dots of Y ink. For each pixel, when the sum total of the number of main dots and the number of subsidiary dots relating to the first and second recording elements (recording elements for C ink dots) and the third and fourth recording elements (recording elements for M ink dots), in other words, relating to particular types of recording elements (the first, second, third and fourth recording elements) associated with two particular colors, namely, cyan and magenta, is equal to or less than the maximum number of dots in a dot pattern (here, "8"), the dot pattern selector unit 124 selects dot patterns such that there is no coincidence between the positions of the main dots, no coincidence between the positions of the subsidiary dots and no coincidence between the positions of the main dots and the positions of the subsidiary droplets, in respect of the recording elements of the particular types relating to the two particular colors of inks (namely, the first, second, third and fourth recording elements).

Furthermore, a mode is also possible in which the coincidence between the dot positions is avoided as described above when in a high-quality recording mode, whereas the coincidence between the dot positions is ignored when in a high-speed recording mode.

In order to simplify the description, a 2 by 4 dot pattern (2 dots×4 dots) is shown in FIG. 3, and it is also possible to adopt a 4 dot by 4 dot pattern (4 dots×4 dots), for example.

Figure 4:
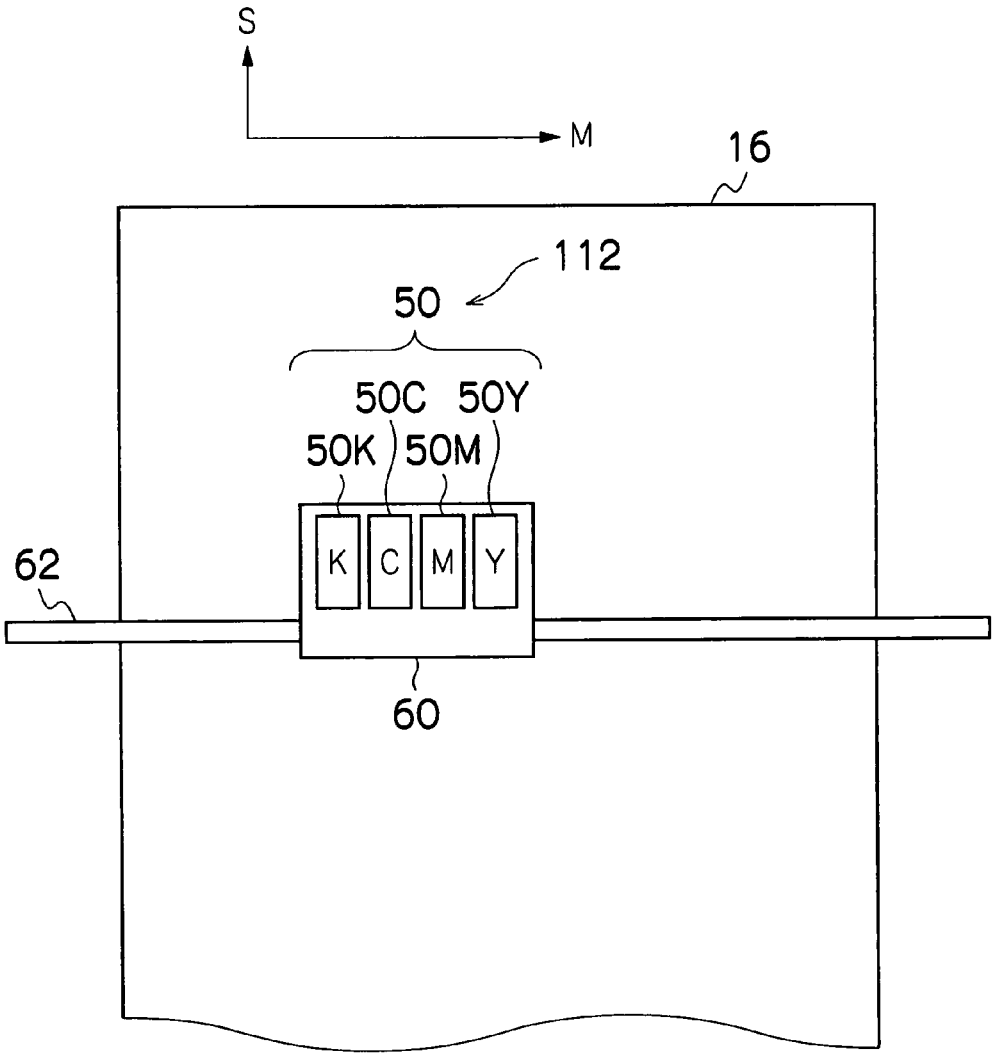
FIG. 4 is a general schematic drawing showing one example of the recording unit shown in FIG. 1.

FIG. 4 is a general schematic drawing showing one embodiment of the recording unit 112 shown in FIG. 1.

In FIG. 4, the recording unit 112 is constituted by a shuttle type (serial type) of recording head 50 which moves back and forth reciprocally in the main scanning direction M. In the present embodiment, the recording unit 112 is constituted by a recording head 50C which ejects droplets of cyan (C) ink, a recording head 50M which ejects droplets of magenta (M) ink, a recording head 50Y which ejects droplets of yellow (Y) ink, and a recording head 50K which ejects droplets of black (K) ink.

Furthermore, the recording head 50 is moved in the main scanning direction, while a carriage 60 is guided by a guide 62 provided in the main scanning direction M. Consequently, the recording head 50 scans the recording medium 16 in the main scanning direction M (in other words, the recording head 50 moves over the recording medium in the main direction M).

Furthermore, the recording medium 16 is conveyed in the sub-scanning direction S by means of a conveyance mechanism (not shown in the drawings). Consequently, the recording head 50 scans the recording medium 16 in the sub-scanning direction S (in other words, the recording head moves relative to the recording medium 16 in the sub-scanning direction S).

Figure 5:
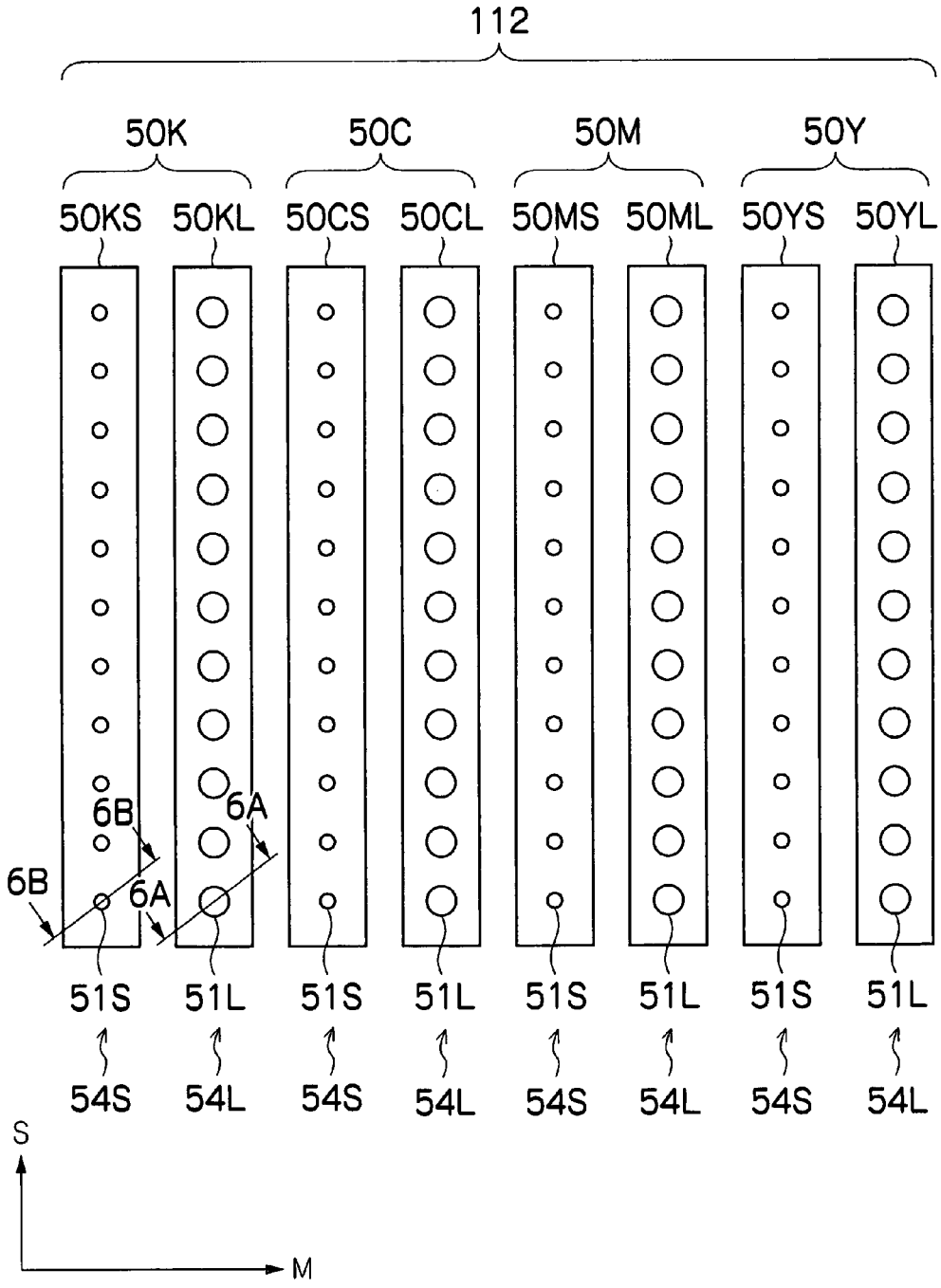
FIG. 5 is a plan diagram of the recording unit shown in FIG. 4 as viewed from the side of the recording medium.

FIG. 5 is a plan diagram of the recording head 50 shown in FIG. 4, as viewed from the side of the recording medium 16.

In FIG. 5, the recording head 50 is constituted by the recording heads 50K, 50C, 50M, and 50Y, which are provided for the respective ink colors. These heads 50K, 50C, 50M, and 50Y are further divided into large dots recording heads 50KL, 50CL, 50ML, and 50YL and small dot recording heads 50KS, 50CS, 50MS and 50YS.

Each of the large dot recording heads 50KL, 50CL, 50ML and 50YL has nozzles 51L having a prescribed diameter for large dots, and the nozzles 51L in each head (50KL, 50CL, 50ML and 50YL) are aligned in the sub-scanning direction S. Each of the small dot recording heads 50KS, 50CS, 50MS and 50YS has nozzles 51S for small dots. The nozzles 51S in each head (50KS, 50CS, 50MS and 50YS) are aligned in the sub-scanning direction S, and the nozzles 51S have diameters smaller than those of the nozzles 51L for large dots.

Figure 6A:
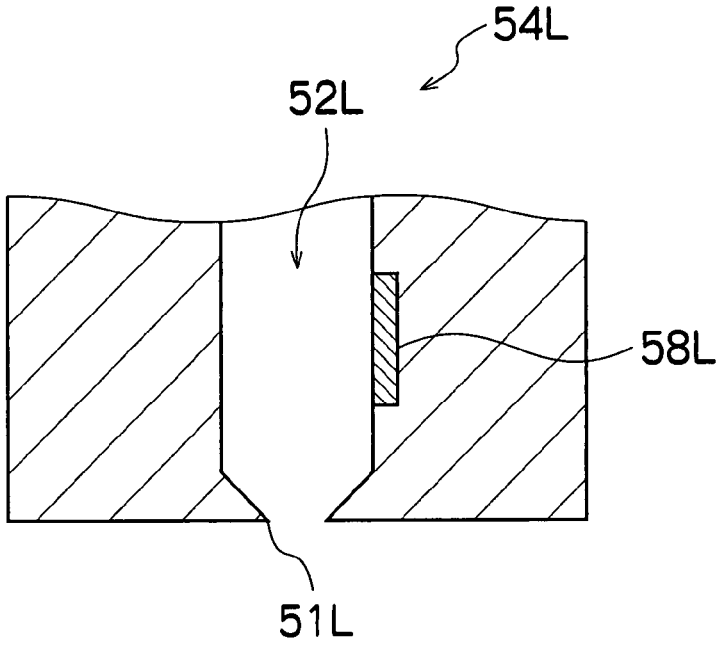
FIG. 6A is a cross-sectional diagram along line 6A-6A in FIG. 5.
Figure 6B:
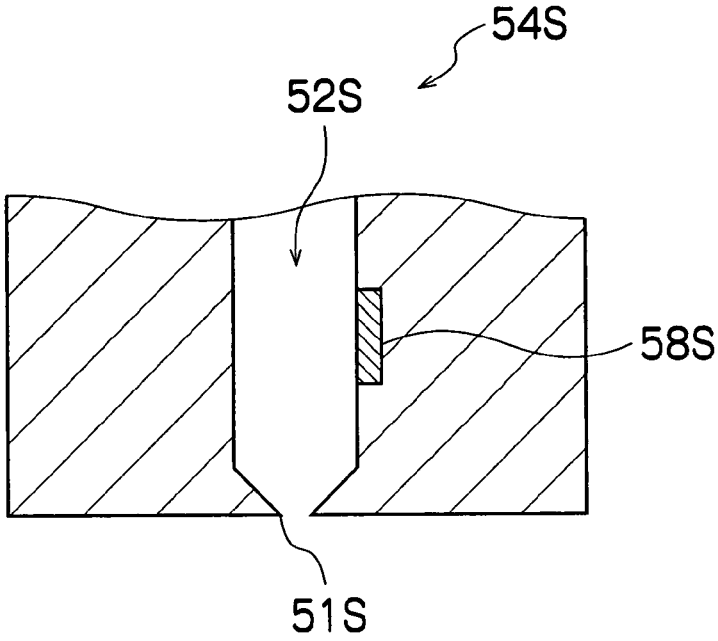
FIG. 6B is a cross-sectional diagram along line 6B-6B in FIG. 5.

Furthermore, FIG. 6A shows a cross-sectional view along line 6A-6A in FIG. 5; and FIG. 6B shows a cross-sectional view along line 6B-6B in FIG. 5.

As shown in FIG. 6A, a large dot recording element 54L is constituted of the nozzle 51L, pressure chamber 52L which is filled with ink, and heater 58L which changes the pressure inside the pressure chamber 52L by generating an ejection bubble in the pressure chamber 52L. Similarly, as shown in FIG. 6B, a small dot recording element 54S is constituted of the nozzle 51S, pressure chamber 52S which is filled with ink, and heater 58S which changes the pressure inside the pressure chamber 52S by generating an ejection bubble in the pressure chamber 52S.

The liquid droplet volume of a main droplet ejected from the nozzle 51S of the small dot recording element 54S is less than the liquid droplet volume of a main droplet ejected from the nozzle 51L of the large dot recording element 54L. Dots of mutually different sizes can be recorded on a recording medium by means of the recording elements 54L and 54S which respectively have nozzles 51L and 51S that eject main droplets of mutually different volumes.

FIGS. 6A and 6B show examples of a case in which a heater is used as a device for generating pressure for ejecting droplets of ink, but in the present invention, the pressure generating devices are not limited in particular to heaters. For example, it is possible to use piezoelectric elements as pressure generating devices.

Figure 7:
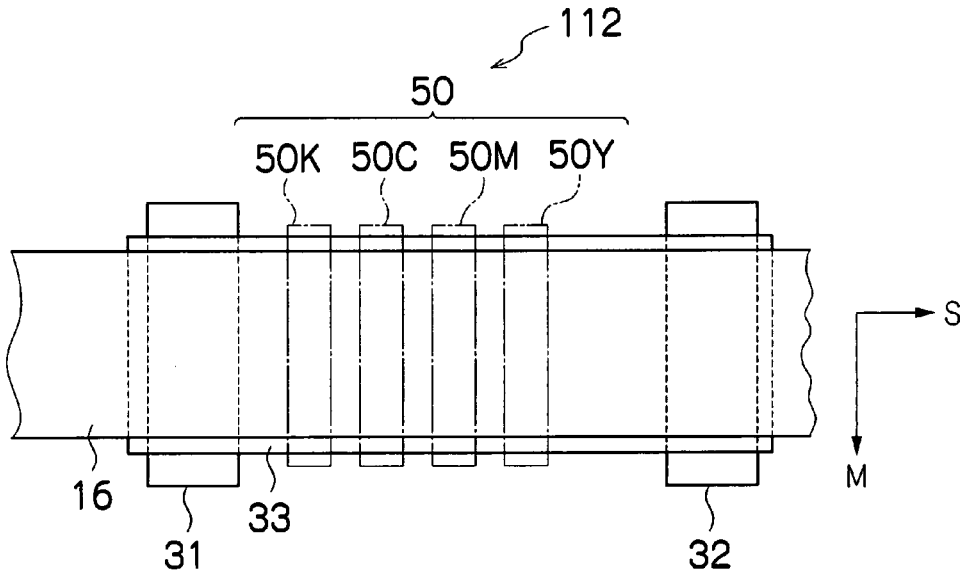
FIG. 7 is a general schematic drawing showing a further example of the recording unit shown in FIG. 1.

FIG. 7 is a general schematic drawing showing a further embodiment of the recording unit 112 shown in FIG. 1.

In FIG. 7, the recording unit 112 is constituted by a so-called full line of recording head 50. In the present embodiment, the recording unit 112 is constituted by a recording head 50C which ejects droplets of cyan (C) colored ink, a recording head 50M which ejects droplets of magenta (M) colored ink, a recording head 50Y which ejects droplets of yellow (Y) colored ink, and a recording head 50K which ejects droplets of black (K) colored ink.

A belt 33 is wound about the pair of rollers 31 and 32, and the recording medium 16 is conveyed in the sub-scanning direction S, by means of the belt 33.

The recording heads 50K, 50C, 50M and 50Y are arranged following a direction (main scanning direction M) which is perpendicular to the conveyance direction of the recording medium 16 (sub-scanning direction S).

Figure 8:
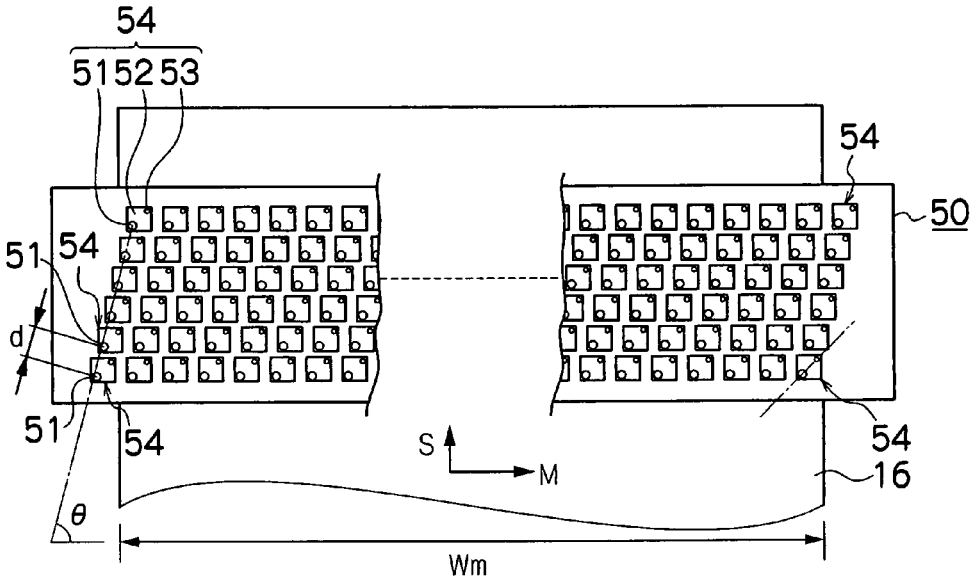
FIG. 8 is a plan view perspective diagram of one recording head which constitutes the recording unit in FIG. 7.

FIG. 8 is a plan view perspective diagram showing the general composition of one of the recording heads 50 shown in FIG. 7.

In FIG. 8, the recording head 50 has a structure in which a plurality of nozzles 51 (liquid ejection ports) which eject droplets of ink toward the recording medium 16 are arranged in a two-dimensional configuration, through a length corresponding to the width Wm of the recording medium 16 in a direction (main scanning direction M) perpendicular to the conveyance direction (sub-scanning direction S) of the recording medium 16.

The recording head 50 includes a plurality of recording elements 54, each having a nozzle 51 which ejects liquid, a pressure chamber 52 connected to the nozzle 51, and a liquid supply port 53 for supplying liquid to the pressure chamber 52, the recording elements 54 being arranged in two directions, namely, a main scanning direction M and an oblique direction forming a prescribed acute angle θ (where $0°<\theta<90°$) with respect to the main scanning direction M. In FIG. 8, in order to simplify the drawing, only a portion of the recording elements 54 are depicted in the drawing.

In specific terms, the nozzles 51 are arranged at a uniform pitch d in the direction forming a prescribed acute angle of θ with respect to the main scanning direction M, and hence the nozzle arrangement can be treated as equivalent to a configuration in which nozzles are arranged at an interval of $d \times \cos\theta$ in a single straight line following the main scanning direction M.

Examples of a device for generating pressure in order to eject droplets of ink include: a heater, a piezoelectric element, and the like.

Figure 9:
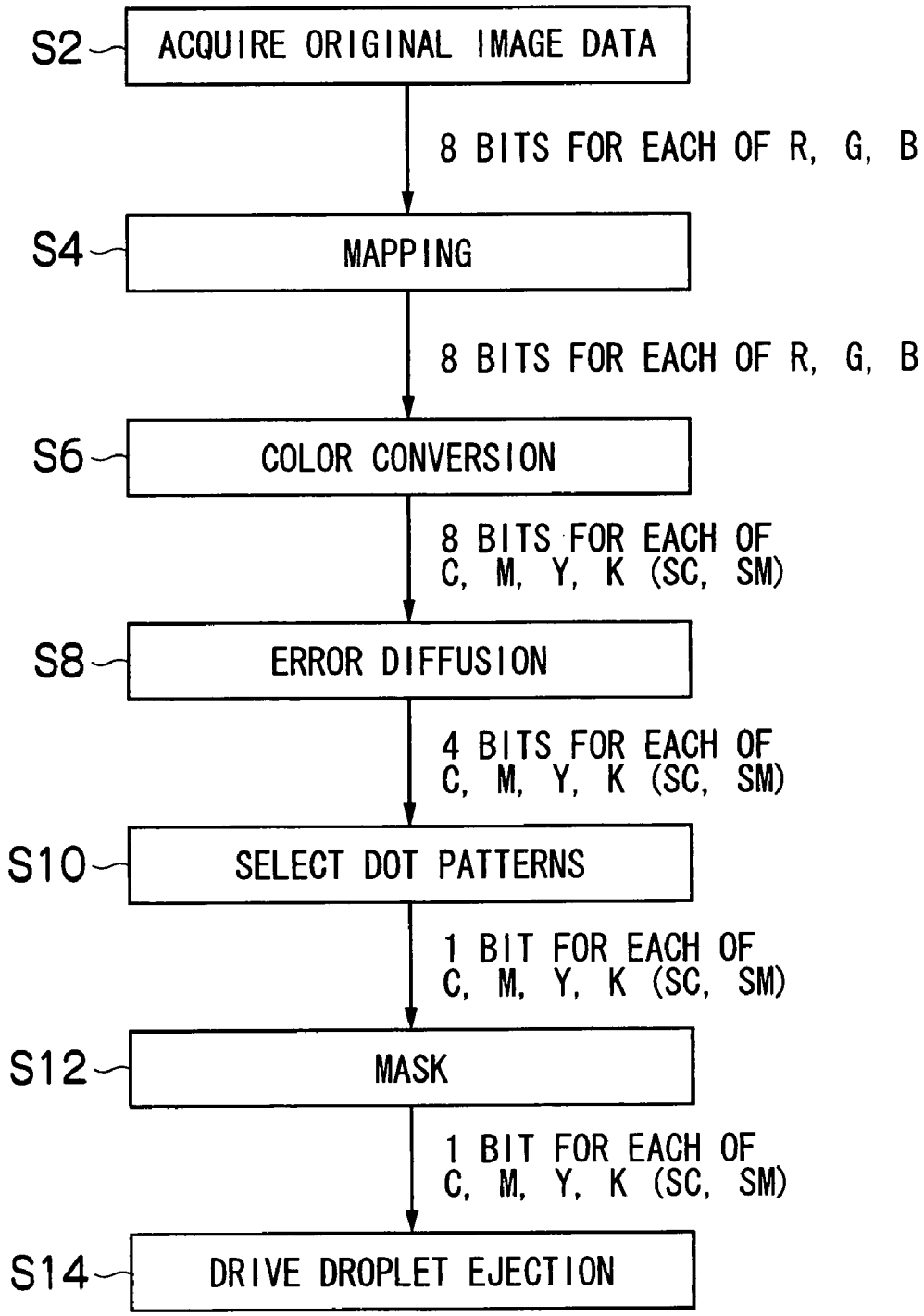
FIG. 9 is a flowchart showing an overview of the sequence of a recording process according to an embodiment of the present invention.

FIG. 9 is a flowchart showing an approximate view of the sequence of one embodiment of a recording process for the inkjet recording apparatus 10. This recording process is carried out in accordance with a prescribed program, by means of the MPU 212 in FIG. 2, which constitutes the image data processing unit 106, the dot pattern selector unit 124, the mask processing unit 119, and the like, shown in FIG. 1.

Firstly, original image data is acquired from the image data buffer 102 shown in FIG. 1 (step S2). Here, the original image data is composed of 8-bit data for the respective colors of red (R), green (G) and blue (B).

Thereupon, the original image data is mapped to the regions of possible color reproduction by the inkjet recording apparatus 10, using a 3D-LUT (3-dimensional lookup table) for mapping (step S4).

Thereupon, the mapped image data is converted into image data which is separated for the respective ink colors of C (cyan), M (magenta), Y (yellow) and K (black), and the respective dot sizes of large dots and small dots (step S6). If using light inks, such as soft cyan (SC) or soft magenta (SM), then image data for these ink colors is also obtained. A 3D-LUT (three-dimensional lookup table) for ink color analysis is used for the separation of the respective ink colors.

Thereupon, error diffusion is carried out as a digital halftoning method (step S8). By this means, recording data composed of pixels having 4-bit graduated tone values of 9 tonal graduations is obtained.

For example, in the case of the recording unit 112 shown in FIG. 5, each pixel of the recording data has: a graduated tone value for recording large dots of K ink; a graduated tone value for recording small dots of K ink; a graduated tone value for recording large dots of C ink; a graduated tone value for recording small dots of C ink; a graduated tone value for recording large dots of M ink; a graduated tone value for recording small dots of M ink; a graduated tone value for recording large dots of Y ink; and a graduated tone value for recording small dots of Y ink. In other words, each pixel of the recording data has graduated tone values for the recording elements of the different combinations of ink color and dot size.

Next, the pixels of the recording data are processed successively, and dot patterns corresponding to the graduated tone values of the pixel under processing are selected from the plurality of dot patterns stored in the dot pattern storage unit 122 shown in FIG. 1 and are developed and stored as the droplet ejection data in the droplet ejection data buffer 118 shown in FIG. 1 (step S10). By this means, droplet ejection data is stored in the droplet ejection data buffer 118, for the whole of the recording area.

For example, in the case of the recording unit 112 shown in FIG. 5, droplet ejection data for recording large dots of K ink, droplet ejection data for recording small dots of K ink, droplet ejection data for recording large dots of C ink, droplet ejection data for recording small dots of C ink, droplet ejection data for recording large dots of M ink, droplet ejection data for recording small dots of M ink, droplet ejection data for recording large dots of Y ink, and droplet ejection data for recording small dots of Y ink, are acquired. In other words, droplet ejection data is obtained for each of the recording elements of the different combinations of ink color and dot size.

Next, droplet ejection data for a single scanning operation of the recording head 50 is extracted from the droplet ejection data for the whole recording area, using a mask (step S12). In the case of a multi-pass method, the droplet ejection data for a single scanning operation is extracted by using a mask which corresponds to that scanning operation.

An image is formed on the recording medium 16 by driving the recording head 50 by means of the recording drive unit 116 in FIG. 1, using the droplet ejection data for a single scanning operation (step S14).

Figure 10:
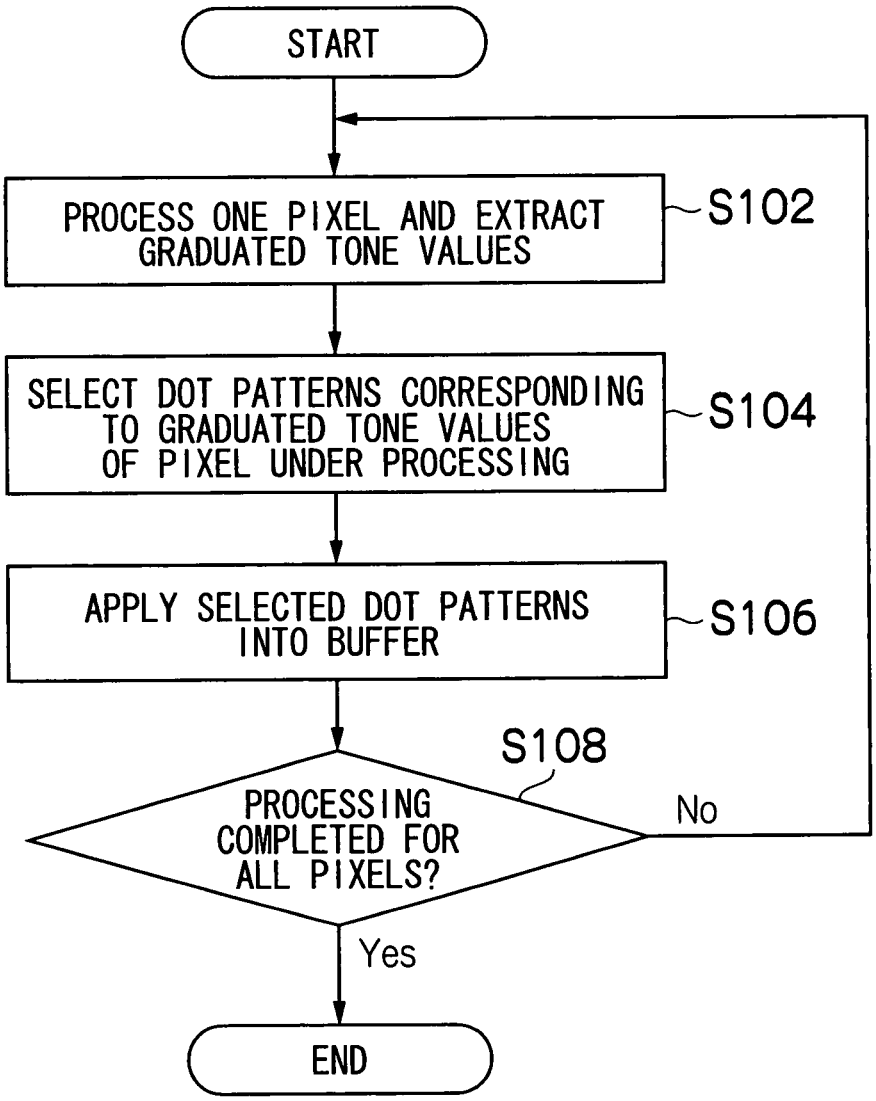
FIG. 10 is a flowchart showing the details of a step of selecting dot patterns in FIG. 9.

FIG. 10 is a flowchart showing the details of the processing in step S10 in FIG. 9.

FIG. 10 shows an example of a case in which the recording unit 112 includes eight types of recording elements of mutually different ink colors (the four colors, K, C, M and Y) and sizes (two sizes: large and small).

Firstly, the pixels of the recording data are processed (examined) successively, and the graduated tone values (for the types of the recording elements) of the pixel under processing are extracted (step S102). In this case, graduated tone values (in other words, eight graduated tone values) for the eight types of recording elements having mutually different combinations of ink color and dot size are extracted.

Thereupon, the dot patterns corresponding to the respective graduated tone values (eight values) of the pixel under processing are selected from the plurality of dot patterns stored in the dot pattern storage unit 122 shown in FIG. 1 (step S104). Here, dot patterns are respectively selected for the eight types of recording elements having mutually different combinations of ink color and dot size (in other words, eight dot patterns are selected for that pixel under processing).

Here, for the pixel under processing, when the total of the number of dots recorded by main droplets and the number of dots recorded by subsidiary droplets from particular recording elements (more specifically, by the four types of recording elements, for respectively recording large dots of C ink, small dots of C ink, large dots of M ink and small dots of M ink), is equal to or less than the maximum number of dots (for example, 8) of the dot pattern which corresponds to the maximum value of the graduated tone value (for example, 8), then a set of dot patterns (eight dot patterns) are selected for that pixel so that there is no coincidence in the positions of the main dots, and no coincidence in the positions of the main dots and the subsidiary dots, between those particular recording elements (more specifically, the four types of recording elements for respectively recording large dots of C ink, small dots of C ink, large dots of M ink and small dots of M ink).

Preferably, in dot patterns thus selected, there is no coincidence in the positions of the main dots, between recording elements of the same type, in respect of the particular types of recording elements (more specifically, the four types of recording elements, for respectively recording large dots of C ink, small dots of C ink, large dots of M ink, and small dots of M ink). Furthermore, in the selected dot pattern, there is preferably no coincidence in the positions of the main dots and the position of the subsidiary dots, between recording elements of the same type, in respect of the particular types of recording elements described above. Moreover, in the selected dot pattern, there is preferably no coincidence in the positions of the subsidiary dots, between recording elements of the same type, in respect of the particular types of recording elements described above. Preferably, in the selected dot pattern, there is also no coincidence in the positions of the subsidiary dots, between recording elements of different types, in respect of the particular types of recording elements described above.

Next, the selected dot pattern is developed and stored in the droplet ejection data buffer 118 shown in FIG. 1 (step S106).

It is judged whether or not processing has been completed for all of the pixels in the recording data (step S108), and the steps S102 to S106 are repeated until this processing is completed.

Below, the procedure for selecting dot patterns is described in detail, with reference to two separate embodiments (Embodiments 1 and 2) of the selecting of dot patterns.

Embodiment 1

In Embodiment 1 (an embodiment relating to the selecting of dot patterns), the recording head 50 has a high-quality recording mode and a high-speed recording mode, in which the recording device moves relative to the recording medium at mutually different scanning speeds. When the recording mode is switched between the two recording modes, the scanning speed is changed according to the recording mode.

Furthermore, in the present embodiment, the recording head 50 has large dot recording elements and small dot recording elements which record dots (main dots) of mutually different sizes on the recording medium by means of the main droplets. Here, in the case of the large dot recording elements, either the occurrence frequency of subsidiary droplets is so small that the subsidiary droplets can be ignored, or the speed of flight of the subsidiary droplets occurring in the recording of large dots is sufficiently fast for the subsidiary droplets to deposit at substantially the same position as the corresponding main droplets, and therefore the subsidiary droplets can be ignored when selecting the dot patterns. On the other hand, in the case of the small dot recording elements, subsidiary droplets which approach the size of the main droplets are deposited at positions which are distant from the main droplets, and therefore the occurrence of subsidiary droplets cannot be ignored.

Figure 11A:
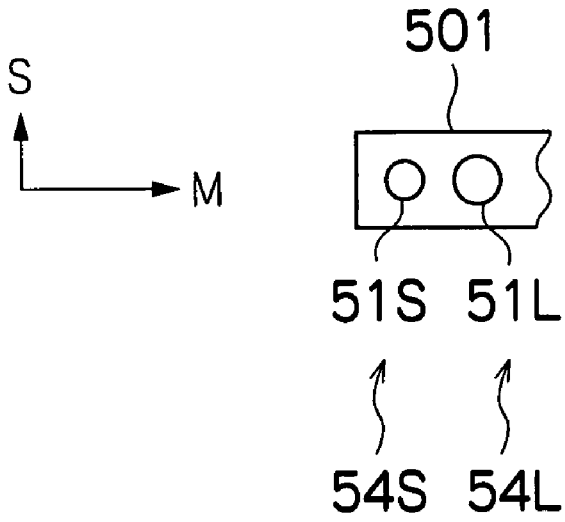
FIGS. 11A and 11B are diagrams showing a simplified recording head for describing an embodiment of the present invention.

In order to simplify the description given below, a simplified recording head 501 shown in FIG. 11A is considered. This recording head 501 includes at least one small dot recording element 54S having the nozzle 51S of small diameter and at least one large dot recording element 54L having the nozzle 51L of large diameter. These recording elements 54S and 54L are aligned in the main scanning direction M.

The resolution of the image formed on the recording medium is 1200 dots per inch (dpi) in the sub-scanning direction and 1200 dpi in the main scanning direction, for example. Furthermore, in the present embodiment, the dot patterns are 2 dot by 4 dot patterns (2 dots×4 dots), the graduated tone value includes 9 tonal graduations (levels 0 to 8; pattern numbers 0 to 8) composed of 4 bits, and the tonal graduation level is equal to the number of main dots in the corresponding dot pattern.

Figure 12A:
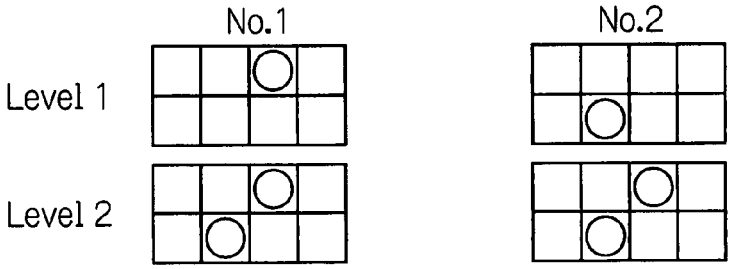
FIGS. 12A to 12C are diagrams showing dot patterns according to a first embodiment of the present invention.
Figure 12B:
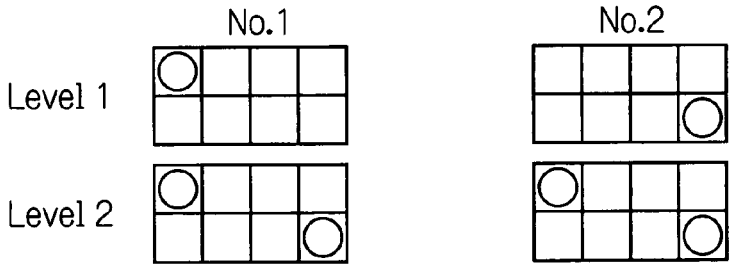
Figure 12C:
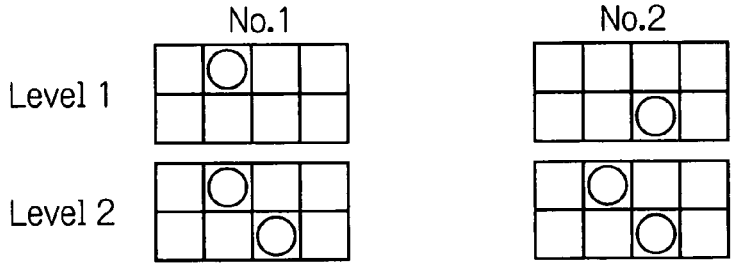

FIGS. 12A, 12B and 12C are diagrams showing examples of a plurality of dot patterns which are stored previously in the dot pattern storage unit 122 in FIG. 1. In all of these drawings, in order to simplify the description, only the dot patterns corresponding to pattern number 1 (level 1) and the dot patterns corresponding to pattern number 2 (level 2) are depicted. In actual practice, dot patterns corresponding to pattern number 0 and pattern numbers 3 to 8 (level 0 and levels 3 to 8) are also stored in the dot pattern storage unit 122.

The dot patterns shown in FIG. 12A are dot patterns which indicate the presence or absence of a main dot (a small main dot) recorded on the recording medium by means of a main droplet from a small dot recording element 54S. The dot patterns shown in FIGS. 12B and 12C are dot patterns which indicate the presence or absence of a main dot (a large main dot) recorded on the recording medium by means of a main droplet from a large dot recording element 54L.

The dot patterns shown in FIG. 12B are for a high-quality recording mode, and the dot patterns shown in FIG. 12C are for a high-speed recording mode. In the case of the dot patterns for the large dot recording element 54L, it depends on the recording mode of the recording head 501 (more specifically, on the scanning speed of the recording head 501) whether the dot patterns shown in FIG. 12B are selected, or whether the dot patterns shown in FIG. 12C are selected.

Firstly, the process of selecting dot patterns in a case where the recording mode is a high-quality recording mode will be described. Here, it is supposed that the graduated tone value of the pixel under processing is level 2.

Firstly, the dot pattern selector unit 124 selects one dot pattern associated with pattern number 2 (level 2), from the plurality of dot patterns (shown in FIG. 12A) for the small dot recording element 54S, which are stored in the dot pattern storage unit 122. In a case where the dot pattern storage unit 122 stores a plurality of dot patterns (as shown in FIG. 12A) having different identification numbers (Nos. 1 and 2) as dot patterns of pattern number 2 for the small dot recording element 54S, then a mode is possible in which these dot patterns are selected in alternating fashion.

Figure 13A:
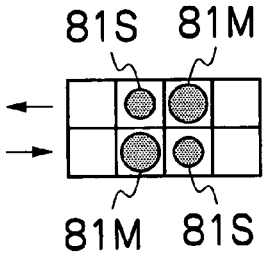
FIGS. 13A to 13C are diagrams showing synthesized dot patterns for a high-quality recording mode according to the first embodiment of the present invention.

FIG. 13A is a diagram showing a synthesized dot pattern which combines a dot pattern selected by the dot pattern selector unit 124 for the small dot recording element 54S (in other words, a dot pattern of main dots 81M recorded by means of main droplets from the small dot recording element 54S), and a dot pattern for subsidiary dots 81S which is recorded by means of subsidiary droplets from the small dot recording element 54S.

In FIG. 13A, the subsidiary dots 81S are disposed in adjacent positions immediately before (in front of) the main dots 81M in terms of the scanning direction (as denoted with the arrows in FIG. 13A). More specifically, in the first processing line of the synthesized dot pattern (the upper line in the drawing), the recording head 501 performs scanning in the leftward direction in the drawing and therefore the subsidiary dot 81S is situated immediately to the left-hand side of the main dot 81M, whereas in the second line of the synthesized dot pattern (the lower line in the drawing), the recording head 501 performs scanning in the rightward direction in FIG. 13A and therefore the subsidiary dot 81S is situated immediately to the right-hand side of the main dot 81M.

Thereupon, the dot pattern selector unit 124 selects one dot pattern associated with level 2, from the plurality of dot patterns (shown in FIG. 12B) for the large dot recording element 54L in the case of the high-quality recording mode, which are stored in the dot pattern storage unit 122.

Figure 13B:
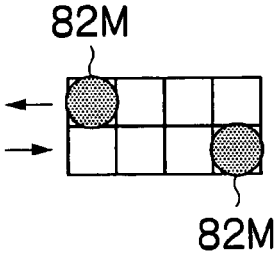

In the present embodiment, the dot pattern selector unit 124 selects one of the dot patterns (shown FIG. 13B) for the large dot recording element 54L so that there is no coincidence in the dot positions (for all the dot positions (2×4=8 dot positions), there is no overlapping of the dots), between the dot pattern for the small dot recording element 54S (the synthesized dot pattern for the main dots 81M and subsidiary dots 81S of the small dot recording element 54S shown in FIG. 13A) and the subsequently selected dot pattern for the large dot recording element 54L.

Figure 13C:
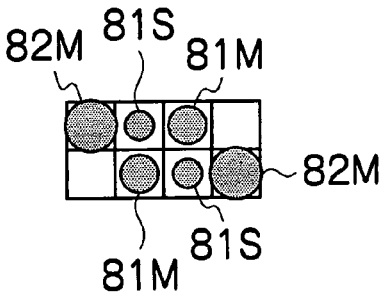

In the present embodiment, as shown in FIG. 13C, there is no coincidence among the positions of the main dots (small main dots) 81M recorded by the main droplets ejected from the small dot recording element 54S, the positions of the subsidiary dots (small subsidiary dots) 81S recorded by means of subsidiary droplets ejected from the small dot recording element 54S, and the positions of the main dots (large main dots) 82M recorded by means of main droplets ejected from the large dot recording element 54L.

Next, the process of selecting one of the dot patterns in a case where the recording mode is a high-speed recording mode will be described. The scanning speed in high-speed recording mode is twice the scanning speed in high-quality recording mode. In this case, it is supposed that the graduated tone value of the pixel under processing is level 2.

Firstly, the dot pattern selector unit 124 selects one of the dot patterns associated with level 2, from the plurality of dot patterns for the small dot recording element 54S shown in FIG. 12A, which are stored in the dot pattern storage unit 122. Up to this stage, the procedure is the same as that relating to the high-quality recording mode.

Figure 14A:
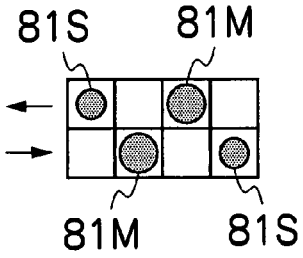
FIGS. 14A to 14C are diagrams showing synthesized dot patterns for a high-speed recording mode according to the first embodiment of the present invention.

FIG. 14A is a diagram showing a synthesized dot pattern which combines a dot pattern (as selected by the dot pattern selector unit 124) for the small dot recording element 54S (in other words, a dot pattern of main dots 81M recorded by means of main droplets from the small dot recording element 54S), and a dot pattern for subsidiary dots 81S which is recorded by means of subsidiary droplets from the small dot recording element 54S.

In the high-speed recording mode, the scanning speed is two times the speed in high-quality recording mode, and therefore, as shown in FIG. 14A, the subsidiary dots 81S are situated two positions before the main dots 81M in terms of the direction of scanning. More specifically, in the first line of the synthesized dot pattern (the upper line in the drawing), the recording head 501 performs scanning in the leftward direction in the drawing and therefore the subsidiary dot 81S is situated two positions to the left-hand side of the main dot 81M, whereas in the second line of the synthesized dot pattern (the lower line in the drawing), the recording head 501 performs scanning in the rightward direction in FIG. 13A and therefore the subsidiary dot 81S is situated two positions to the right-hand side of the main dot 81M.

Thereupon, the dot pattern selector unit 124 selects one of the dot patterns associated with pattern number 2 (level 2), from the plurality of dot patterns (shown in FIG. 12C) for the large dot recording element 54L in the case of the high-speed recording mode, which are stored in the dot pattern storage unit 122.

Figure 14B:
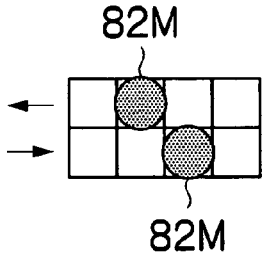

In the present embodiment, the dot pattern selector unit 124 selects one of the dot patterns (shown FIG. 14B) for the large dot recording element 54L so that there is no coincidence in the positions of any of the dots (the eight dot positions), between the synthesized dot pattern for the main dots 81M and subsidiary dots 81S of the small dot recording element 54S shown in FIG. 14A, and the subsequently selected dot pattern for the large dot recording element 54L.

Figure 14C:
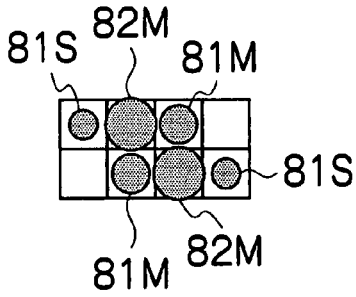

In the present embodiment, as shown in FIG. 14C, there is no coincidence among the positions of the main dots (small main dots) 81M recorded by the main droplets ejected from the small dot recording element 54S, the positions of the subsidiary dots (small subsidiary dots) 81S recorded by means of subsidiary droplets ejected from the small dot recording element 54S, and the positions of the main dots (large main dots) 82M recorded by means of main droplets ejected from the large dot recording element 54L.

Embodiment 2

In Embodiment 2, the recording head 50 has a high-quality recording mode and a high-speed recording mode, which involve mutually different scanning speeds. When the recording mode is switched between the two recording modes, the scanning speed is changed according to the recording mode.

In the present embodiment, the recording head 50 includes a plurality of recording elements which eject droplets of inks of mutually different colors. More specifically, the recording head 50 includes C ink recording elements which eject droplets of cyan (C) colored ink, M ink recording elements which eject droplets of magenta (M) colored ink, and Y ink recording elements which eject droplets of yellow (Y) colored ink. Here, the C ink recording elements, the M ink recording elements and the Y ink recording elements all generate subsidiary droplets as well as main droplets. In the present embodiment, any coincidence in the positions of the C dots and the M dots has a significant visible effect and is therefore taken into account, whereas any coincidence in the positions of the C dots and the Y dots, or coincidence in the positions of the M dots and the Y dots has little visible effect, and is therefore ignored.

Figure 11B:
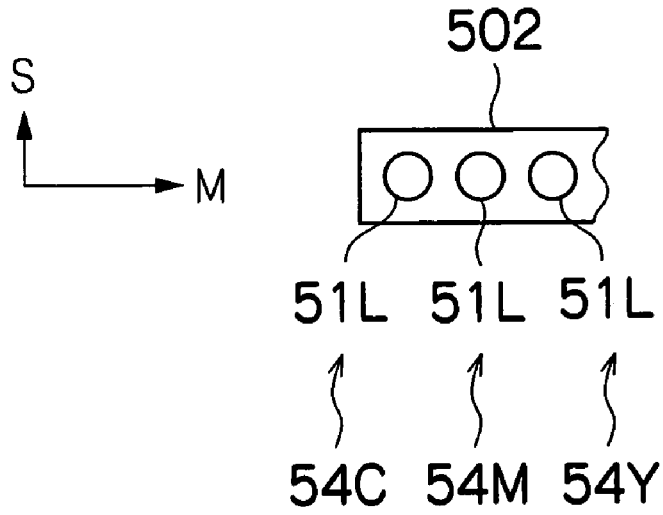

In order to simplify the description given below, the simplified recording head 502 shown in FIG. 11B will be considered. This recording head 502 has at least one C ink recording element 54C, one M ink recording element 54M, and one Y ink recording element 54Y. Each of the recording elements (recording elements 54C, 54M, and 54Y) has nozzles 51L of the same diameter. These recording elements 54M, 54C and 54Y are arranged in alignment in the main scanning direction M.

The resolution of the image formed on the recording medium is 1200 dpi in the sub-scanning direction and 1200 dpi in the main scanning direction, for example. Furthermore, in the present embodiment, similarly to Embodiment 1 described above, the dot patterns are 2 dot by 4 dot patterns, the graduated tone value includes 9 tonal graduations (levels 0 to 8; pattern numbers 0 to 8) composed of 4 bits, and the tonal graduation level is equal to the number of main dots to be arranged in the corresponding dot pattern.

Figure 15A:
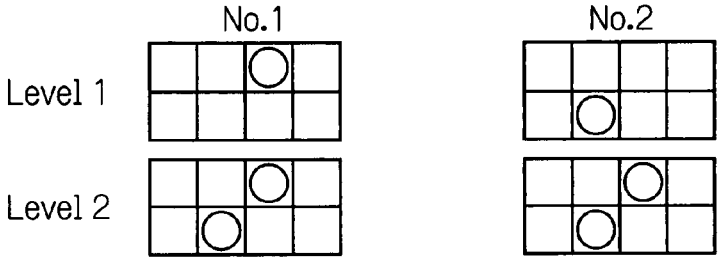
FIGS. 15A to 15C are diagrams showing dot patterns according to a second embodiment of the present invention.
Figure 15B:
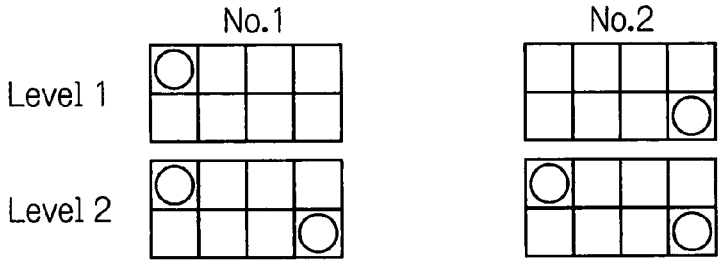
Figure 15C:
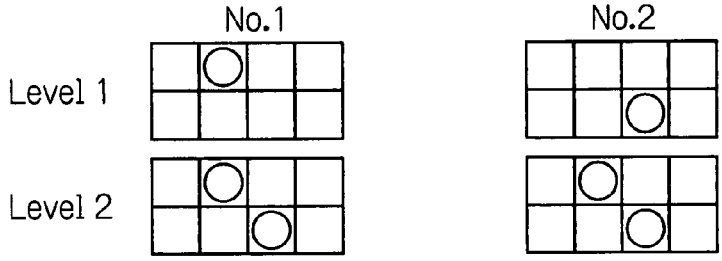

FIGS. 15A, 15B and 15C are diagrams showing examples of a plurality of dot patterns which are stored previously in the dot pattern storage unit 122 in FIG. 1. In all of these drawings, in order to simplify the description, only the dot patterns corresponding to pattern number 1 (level 1) and the dot patterns corresponding to pattern number 2 (level 2) are depicted. In actual practice, dot patterns corresponding to pattern number 0 and pattern numbers 3 to 8 (level 0 and levels 3 to 8) are also stored in the dot pattern storage unit 122.

The dot patterns shown in FIG. 15A are dot patterns (i.e., dot patterns specifying the arrangements of the main dots of C ink) which indicate the presence or absence of a main dot (a C main dot) recorded by means of a main droplet from a C ink recording element 54C. The dot patterns shown in FIGS. 15B and 15C are dot patterns (i.e., dot patterns specifying the arrangements of the main dots of M ink) which indicate the presence or absence of a main dot (an M main dot) recorded on the recording medium by means of a main droplet from an M ink recording element 54M. The dot pattern (i.e., dot patterns specifying the arrangement of the main dots of Y ink) showing the presence or absence of a main dot recorded by means of a main droplet from a Y ink recording element 54Y is omitted from the drawings.

The dot patterns shown in FIG. 15B are for a high-quality recording mode, and the dot patterns shown in FIG. 15C are for a high-speed recording mode. In the case of the dot patterns for the M ink recording element 54M, it depends on the recording mode of the recording head 502 (more specifically, on the scanning speed of the recording head) whether the dot patterns shown in FIG. 15B are selected, or whether the dot patterns shown in FIG. 15C are selected.

Firstly, the process of selecting one of the dot patterns in a case where the recording mode is a high-quality recording mode will be described. Here, it is supposed that the graduated tone value of the pixel under processing is level 2.

Firstly, the dot pattern selector unit 124 selects one of the dot patterns associated with pattern number 2 (level 2), from the plurality of dot patterns for the C ink recording element 54C shown in FIG. 15A, which are stored in the dot pattern storage unit 122. In a case where the dot pattern storage unit 122 stores a plurality of dot patterns having different identification numbers as dot patterns of pattern number 2 (level 2) for the C ink recording element 54C, a mode is possible in which these dot patterns are selected in alternating fashion.

Figure 16A:
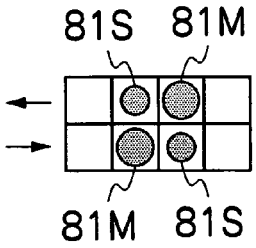
FIGS. 16A to 16C are diagrams showing synthesized dot patterns for a high-quality recording mode according to the second embodiment of the present invention.

FIG. 16A is a diagram showing a synthesized dot pattern which combines a dot pattern (as selected by the dot pattern selector unit 124) for the C ink recording element 54C (in other words, a dot pattern of main dots 81M recorded by means of main droplets from the C ink recording element 54C), and a dot pattern for subsidiary dots 81S which is recorded by means of subsidiary droplets from the C ink recording element 54C.

In FIG. 16A, the subsidiary dots 81S are disposed in adjacent positions immediately before the main dots 81M in terms of the scanning direction. More specifically, in the first line of the synthesized dot pattern (the upper line in the drawing), the recording head 502 performs scanning in the leftward direction in the drawing and therefore the subsidiary dot 81S is situated immediately to the left-hand side of the main dot 81M, whereas in the second line of the synthesized dot pattern (the lower line in the drawing), the recording head 502 performs scanning in the rightward direction in FIG. 13A and therefore the subsidiary dot 81S is situated immediately to the right-hand side of the main dot 81M.

Thereupon, the dot pattern selector unit 124 selects one of the dot patterns associated with pattern number 2 (level 2), from the plurality of dot patterns (shown in FIG. 15B) for the M ink recording element 54M in the case of the high-quality recording mode, which are stored in the dot pattern storage unit 122.

Figure 16B:
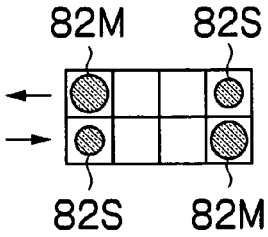

FIG. 16B is a diagram showing a synthesized dot pattern which combines a dot pattern (as selected by the dot pattern selector unit 124) for the M ink recording element 54M (in other words, a dot pattern of main dots 82M recorded by means of main droplets from the M ink recording element 54M), and a dot pattern for subsidiary dots 82S which are recorded by means of subsidiary droplets from the M ink recording element 54M.

In the present embodiment, the dot pattern selector unit 124 selects one of the dot patterns for the M ink recording element 54M so that there is no coincidence in the positions of any of the dots (8 dot positions), between the synthesized dot pattern of the main dots 81M and subsidiary dots 81S of the C ink recording element 54C shown in FIG. 16A, and the synthesized dot pattern of the main dots 82M and the subsidiary dots 82S of the M ink recording element 54M shown in FIG. 16B.

Figure 16C:
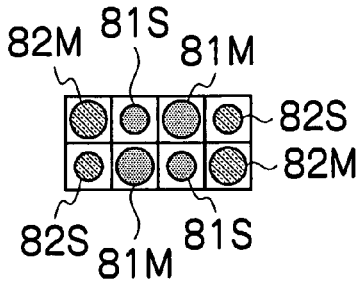

In the present embodiment, as shown in FIG. 16C, there is no coincidence among: the positions of the main dots 81M recorded by the main droplets ejected from the C ink recording element 54C (C main dots); the positions of the subsidiary dots 81S recorded by means of subsidiary droplets ejected from the C ink recording element 54C (C subsidiary dots); the positions of the main dots 82M recorded by means of main droplets ejected from the M ink recording element 54M (M main dots); and the subsidiary dots 82S recorded by means of the subsidiary droplets ejected from the M ink recording element 54M (M subsidiary dots).

Next, the process of selecting one of the dot patterns in a case where the recording mode is a high-speed recording mode will be described. The scanning speed in high-speed recording mode is twice the scanning speed in high-quality recording mode. Furthermore, it is supposed that the graduated tone value of the pixel under processing is level 2.

Firstly, the dot pattern selector unit 124 selects one of the dot patterns associated with pattern number 2 (level 2), from the plurality of dot patterns for the C ink recording element 54C shown in FIG. 15A, which are stored in the dot pattern storage unit 122. Up to this stage, the procedure is the same as that relating to the high-quality recording mode.

Figure 17A:
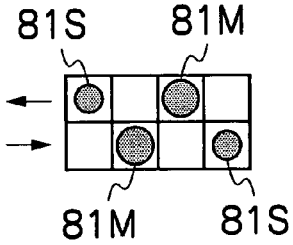
FIGS. 17A to 17C are diagrams showing synthesized dot patterns for a high-speed recording mode according to the second embodiment of the present invention.

FIG. 17A is a diagram showing a synthesized dot pattern which combines a dot pattern (as selected by the dot pattern selector unit 124) for the C ink recording element 54C (in other words, a dot pattern of main dots 81M recorded by means of main droplets from the C ink recording element 54C), and a dot pattern for subsidiary dots 81S which are recorded by means of subsidiary droplets from the C ink recording element 54C.

In the high-speed recording mode, the scanning speed is two times the speed in high-quality recording mode, and therefore, in FIG. 17A, the subsidiary dots 81S are situated two positions before the main dots 81M in terms of the scanning direction. More specifically, in the first line of the synthesized dot pattern (the upper line in the drawing), the recording head 502 performs scanning in the leftward direction in the drawing and therefore the subsidiary dot 81S is situated two positions to the left-hand side of the main dot 81M, whereas in the second line of the synthesized dot pattern (the lower line in the drawing), the recording head 502 performs scanning in the rightward direction in FIG. 17A and therefore the subsidiary dot 81S is situated two positions to the right-hand side of the main dot 81M.

Thereupon, the dot pattern selector unit 124 selects one of the dot patterns associated with pattern number 2 (level 2), from the plurality of dot patterns for the M dots in the case of the high-speed recording mode shown in FIG. 15C, which are stored in the dot pattern storage unit 122.

Figure 17B:
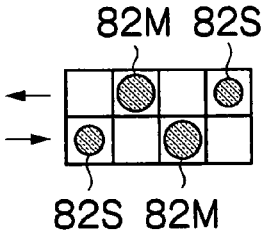

FIG. 17B is a diagram showing a synthesized dot pattern which combines a dot pattern (as selected by the dot pattern selector unit 124) for the M ink recording element 54M (in other words, a dot pattern of main dots 82M recorded by means of main droplets from the M ink recording element 54M), and a dot pattern for subsidiary dots 82S which is recorded by means of subsidiary droplets from the M ink recording element 54M.

Figure 17C:
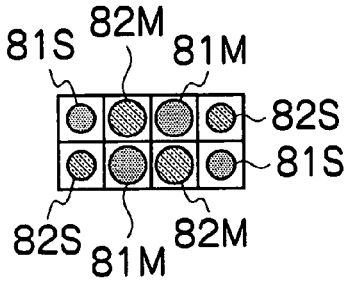
Figure 18:
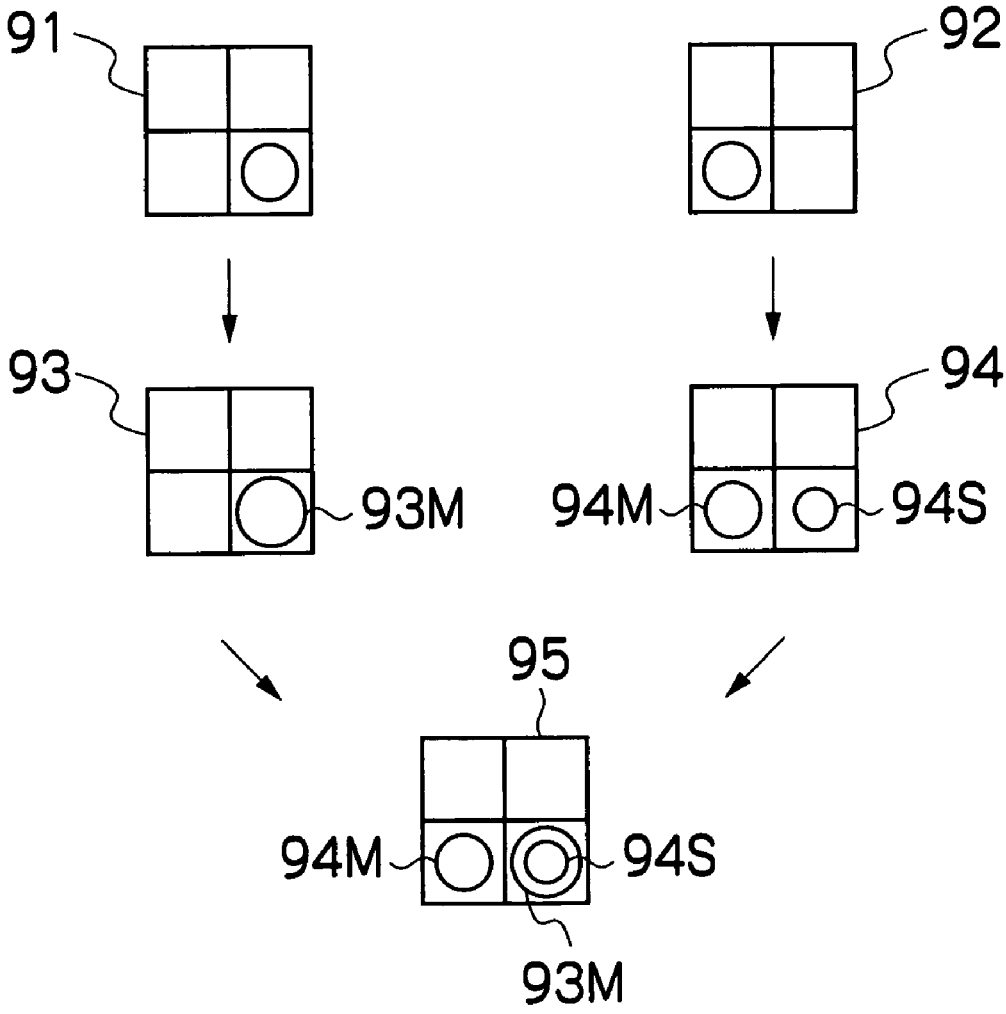
FIG.18 RELATED ART
FIG. 18 is an illustrative diagram used to describe issues in the related art.

In the present embodiment, as shown in FIG. 17C, there is no coincidence among: the positions of the main dots 81M recorded by the main droplets ejected from the C ink recording element 54C (C main dots); the positions of the subsidiary dots 81S recorded by means of subsidiary droplets ejected from the C ink recording element 54C (C subsidiary dots); the positions of the main dots 82M recorded by means of main droplets ejected from the M ink recording element 54M (M main dots); and the subsidiary dots 82S recorded by means of the subsidiary droplets ejected from the M ink recording element 54M (M subsidiary dots).

In Embodiment 1, the coincidence among the dot positions of the main droplets and the dot positions of the subsidiary droplets is avoided, in respect of a small dot recording element 54S and a large dot recording element 54L which record dots of mutually different sizes. In Embodiment 2, the coincidence among the dots positions of main droplets and the dot positions of subsidiary droplets is avoided, in respect of the two recording elements (in other words, the C ink recording element 54C and the M ink recording element 54M) of the C ink recording element 54C, the M ink recording element 54M and the Y ink recording element 54Y, which record inks of mutually different colors. However, the present invention is not limited to these embodiments.

For example, the recording unit 112 may also have eight types of recording elements having different combinations of ink color (C ink, M ink, Y ink, and K ink) and dot size (large dot and small dot), and a mode is possible in which the coincidence is avoided among the dot positions of the main droplets and the dot positions of the subsidiary droplets, in respect of recording elements of different types with respect to two ink colors (C ink and M ink). More specifically, it is also possible to adopt a composition in which each pixel of the recording data is processed successively, and for the pixel under processing, if the total number of main dots and subsidiary dots from recording elements of four particular types (e.g., a recording element for large dots of C ink, a recording element for small dots of C ink, a recording element for large dots of M ink and a recording element for small dots of M ink) is equal to or less than a number (k) of the main dots to be recorded by one recording element if a graduated tone value for the one recording element is m, then the dot pattern selector unit 124 selects dot patterns such that there is no coincidence in the dot positions of the main droplets with each other, there is no coincidence in the dot positions of the subsidiary droplets, and no coincidence in the dot positions of the main droplets and the dot positions of the subsidiary droplets with each other, among the aforementioned four particular types of recording elements which record different types of dots. In this case, for each pixel of the recording data, the dot patterns that are beforehand stored in the dot pattern storage unit 122 are preferably such that there is no coincidence in the dot positions of the main droplets, no coincidence in the dot positions of the subsidiary droplets, and there is no coincidence in the dot positions of the main droplets and the dot positions of the subsidiary droplets, between the dot patterns corresponding to the respective tonal graduations of the graduated tone values used in one recording element and the dot patterns corresponding to the respective tonal graduations of the graduated tone values used in another recording element, in respect of the four particular types of recording elements described above, if the sum of the number main dots and the number of subsidiary dots from the particular four types of recording elements described above is equal to or less than the maximum number of dots in the dot pattern corresponding to the maximum value of the graduated tone value. In other words, the dot pattern storage device beforehand preferably stores the dot patterns including a first dot pattern stored in association with one of the pattern numbers for a first type of the types of the recording elements and a second dot pattern stored in association with one of the pattern numbers for a second type of the types of the recording elements so that, between the first dot pattern and the second dot pattern, there is no coincidence in the positions of the main dots with each other and there is no coincidence in the positions of the main dots with the positions of the subsidiary dots, if a relationship of $o+p \leqq k$ is satisfied between the first dot pattern and the second dot pattern, where o is a total number of the main dots arranged in the first dot pattern and the second dot pattern, and p is a total number of the subsidiary dots accompanying the main dots in the first dot pattern and the second dot pattern.

The present invention is not limited to the embodiments described in the present specification or shown in the drawings, and various design modifications and improvements may of course be implemented without departing from the scope of the present invention.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A recording apparatus which records dots on a recording medium in accordance with recording data for a plurality of pixels, the recording apparatus comprising:

a recording device which includes recording elements of a plurality of types which record the dots of mutually different types on the recording medium by performing ejection and deposition of ink droplets onto the recording medium, each of the recording elements having a single nozzle, the ink droplets including main droplets forming main dots on the recording medium and satellite droplets accompanying the main droplets and forming subsidiary dots on the recording medium, the ejection of each of the satellite droplets from the single nozzle of a corresponding one of the recording elements following the ejection of a corresponding one of the main droplets from the same single nozzle of the same one of the recording elements and each of the satellite droplets being thereby ejected subsequently to the corresponding one of the main droplets, each of the pixels having a plurality of graduated tone values respectively for the plurality of types of the recording elements, each of the graduated tone values being an integer not less than 0 and not greater than m that is not less than 2;

a dot pattern storage device which beforehand stores a plurality of dot patterns specifying arrangements of the main dots for each of the plurality of types of the recording elements, the plurality of dot patterns being stored respectively in association with pattern numbers which are integers from 0 through m;

a buffer device which stores droplet deposition data used by the recording device for the deposition of the ink droplets; and a dot pattern selector device which selects the dot patterns from the dot pattern storage device corresponding respectively to the graduated tone values for the plurality of types of the recording elements, the selected dot patterns being developed and stored as the droplet deposition data on the buffer device, wherein when one of the pixels satisfies a relationship of $i+j \leqq k$, where i is a total number of the main dots to be recorded for the one of the pixels by the recording elements of at least two of the types, j is a total number of the subsidiary dots to be recorded for the one of the pixels by the recording elements of the at least two of the types, and k is a number of the main dots to be recorded for the one of the pixels by the recording elements of one of the types if a graduated tone value of the one of the pixels for the recording elements of the one of the types is m, then the dot pattern selector device selects the dot patterns for the one of the pixels so that, between the recording elements of different types of the at least two types, there is no coincidence in positions of the main dots with each other and there is no coincidence in the positions of the main dots with positions of the subsidiary dots.

2. The recording apparatus as defined in claim 1, wherein the recording elements of the plurality of types record the dots of the mutually different types that are mutually different in terms of at least one of ink color and dot size.

3. The recording apparatus as defined in claim 1, wherein when the one of the pixels satisfies the relationship of $i+j \leqq k$, then the dot pattern selector device selects the dot patterns for the one of the pixels so that, between the recording elements of a same type of the at least two types, there is no coincidence in the positions of the main dots with each other and there is no coincidence in the positions of the main dots with the positions of the subsidiary dots.

4. The recording apparatus as defined in claim 1, wherein when the one of the pixels satisfies the relationship of $i+j \leqq k$, then the dot pattern selector device selects the dot patterns for the one of the pixels so that, between the recording elements of a same type of the at least two types, there is no coincidence in the positions of the subsidiary dots with each other.

5. The recording apparatus as defined in claim 1, wherein when the one of the pixels satisfies the relationship of $i+j \leqq k$, then the dot pattern selector device selects the dot patterns for the one of the pixels so that, between the recording elements of the different types of the at least two types, there is no coincidence in the positions of the subsidiary dots with each other.

6. The recording apparatus as defined in claim 1, wherein the dot pattern storage device beforehand stores the plurality of dot patterns including a first dot pattern stored in association with one of the pattern numbers for a first type of the types of the recording elements and a second dot pattern stored in association with one of the pattern numbers for a second type of the types of the recording elements so that, between the first dot pattern and the second dot pattern, there is no coincidence in the positions of the main dots with each other and there is no coincidence in the positions of the main dots with the positions of the subsidiary dots, if a relationship of $o+p \leqq k$ is satisfied between the first dot pattern and the second dot pattern, where o is a total number of the main dots arranged in the first dot pattern and the second dot pattern, and p is a total number of the subsidiary dots accompanying the main dots in the first dot pattern and the second dot pattern.

7. The recording apparatus as defined in claim 1, wherein:

the recording device has a plurality of recording modes in which the recording device moves relative to the recording medium at mutually different scanning speeds, the recording device selecting one of the recording modes to record the dots on the recording medium;

the dot pattern storage device stores the dot patterns in association with the plurality of recording modes; and the dot pattern selector device selects the dot patterns in accordance with the selected recording mode so that, between the recording elements of the different types of the at least two types, there is no coincidence in the positions of the main dots with each other and there is no coincidence in the positions of the main dots with the positions of the subsidiary dots.

8. The recording apparatus as defined in claim 1, wherein:

the recording device has a plurality of recording modes including a high-quality recording mode for forming an image at higher quality on the recording medium than another of the recording modes; and at least when the recording device is operated in the high-quality recording mode, the dot pattern selector device selects the dot patterns so that, between the recording elements of the different types of the at least two types, there is no coincidence in the positions of the main dots with each other and there is no coincidence in the positions of the main dots with the positions of the subsidiary dots.

9. The recording apparatus as defined in claim 1, wherein:

the plurality of types of the recording elements include a first type and a second type, the main dots recorded by the recording element of the first type being smaller than the main dots recorded by the recording element of the second type; and when the one of the pixels satisfies the relationship of $i+j \leqq k$ where the at least two of the types are the first type and the second type, the dot pattern selector device selects the dot patterns so that there is no coincidence among positions of the main dots recorded by the recording element of the first type, positions of the subsidiary dots recorded by the recording element of the first type, and positions of the main dots recorded by the recording element of the second type.

10. The recording apparatus as defined in claim 1, wherein:

the plurality of types of the recording elements include a first type and a second type which record the main dots with mutually different colors on the recording medium; and when the one of the pixels satisfies the relationship of $i+j \leqq k$ where the at least two of the types are the first type and the second type, the dot pattern selector device selects the dot patterns so that there is no coincidence among positions of the main dots recorded by the recording element of the first type, positions of the subsidiary dots recorded by the recording element of the first type, positions of the main dots recorded by the recording element of the second type, and positions of the subsidiary dots recorded by the recording element of the second type.

11. The recording apparatus as defined in claim 10, wherein:

the plurality of types of the recording elements further include a third type, the recording element of the third type ejecting droplets of yellow color ink;

the recording element of the first type ejects droplets of cyan color ink;

the recording element of the second type ejects droplets of magenta color ink; and when the one of the pixels satisfies the relationship of $i+j \leqq k$ where the at least two of the types are the first type and the second type, the dot pattern selector device selects the dot patterns so that there is no coincidence among the positions of the main dots recorded by the recording element of the first type, the positions of the subsidiary dots recorded by the recording element of the first type, the positions of the main dots recorded by the recording element of the second type, and the positions of the subsidiary dots recorded by the recording element of the second type.

12. The recording apparatus as defined in claim 1, wherein:

the recording elements of the plurality of types record the dots of mutually different types that are mutually different in terms of a combination of ink color and dot size;

the plurality of types of the recording elements are categorized into at least a first group and a second group, the recording elements of the types of the first group recording the dots of a first ink color, the recording elements of the types of the second group recording the dots of a second ink color; and when the one of the pixels satisfies the relationship of $i+j \leqq k$ where the at least two of the types are the types belonging to the first group and the second group, the dot pattern selector device selects the dot patterns so that there is no coincidence in positions of the main dots of the first ink color and the second ink color with each other, there is no coincidence in positions of the subsidiary dots of the first ink color and the second ink color with each other, and there is no coincidence in the positions of the main dots of the first ink color and the second ink color with the positions of the subsidiary dots of the first ink color and the second ink color.

13. The recording apparatus as defined in claim 12, wherein the first ink color is magenta, and the second ink color is cyan.

14. A recording method for a recording apparatus which records dots on a recording medium in accordance with recording data for a plurality of pixels by means of a recording device, the recording device including recording elements of a plurality of types which record the dots of mutually different types on the recording medium by performing ejection and deposition of ink droplets onto the recording medium, each of the recording elements having a single nozzle, the ink droplets including main droplets forming main dots on the recording medium and satellite droplets accompanying the main droplets and forming subsidiary dots on the recording medium, the ejection of each of the satellite droplets from the single nozzle of a corresponding one of the recording elements following the ejection of a corresponding one of the main droplets from the same single nozzle of the same one of the recording elements and each of the satellite droplets being thereby ejected subsequently to the corresponding one of the main droplets, each of the pixels having a plurality of graduated tone values respectively for the plurality of types of the recording elements, each of the graduated tone values being an integer not less than 0 and not greater than m that is not less than 2, the recording method comprising the steps of:

storing in a storage device a plurality of dot patterns specifying arrangements of the main dots for each of the plurality of types of the recording elements, the plurality of dot patterns being stored respectively in association with pattern numbers which are integers from 0 through m;

then selecting the dot patterns from the storage device corresponding respectively to the graduated tone values for the plurality of types of the recording elements;

then developing and storing the selected dot patterns as droplet deposition data on a buffer device; and then recording the dots on the recording medium by means of the recording device, by using the droplet ejection data, wherein in the step of selecting the dot patterns, when one of the pixels satisfies a relationship of $i+j \leqq k$, where i is a total number of the main dots to be recorded for the one of the pixels by the recording elements of at least two of the types, j is a total number of the subsidiary dots to be recorded for the one of the pixels by the recording elements of the at least two of the types, and k is a number of the main dots to be recorded for the one of the pixels by the recording elements of one of the types if a graduated tone value of the one of the pixels for the recording elements of the one of the types is m, then the dot patterns are selected for the one of the pixels so that, between the recording elements of different types of the at least two types, there is no coincidence in positions of the main dots with each other and there is no coincidence in the positions of the main dots with positions of the subsidiary dots.

15. The recording apparatus as defined in claim 1, wherein when one of the satellite droplets and the corresponding one of the main droplets ejected from the same single nozzle of the same one of the recording elements are deposited at positions on the recording medium distant from each other, the one of the satellite droplets forms one of the subsidiary dots.

16. The recording apparatus as defined in claim 1, wherein when one of the satellite droplets and the corresponding one of the main droplets ejected from the same single nozzle of the same one of the recording elements are deposited at a same position on the recording medium, a dot formed from the one of the satellite droplets is left out of calculation of the total number j of the subsidiary dots and ignored when the dot pattern selector device selects the dot patterns.

17. The recording apparatus as defined in claim 1, further comprising:

a moving device which moves the recording device relatively with respect to the recording medium in a relative movement direction, wherein each of the satellite droplets and the corresponding one of the main droplets ejected from the same single nozzle of the same one of the recording elements are deposited at adjacent positions on the recording medium distant from each other in the relative movement direction.

18. The recording apparatus as defined in claim 17, wherein the adjacent positions are distant from each other in the relative movement direction by one or two positions in a matrix of the dot patterns.

* * * * *